US006581537B2

(12) United States Patent
McBride et al.

(10) Patent No.: US 6,581,537 B2
(45) Date of Patent: Jun. 24, 2003

(54) PROPULSION OF UNDERWATER VEHICLES USING DIFFERENTIAL AND VECTORED THRUST

(75) Inventors: Mark W. McBride, Bellefonte, PA (US); Frank S. Archibald, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 10/087,488

(22) Filed: Mar. 1, 2002

(65) Prior Publication Data

US 2002/0178990 A1 Dec. 5, 2002

Related U.S. Application Data

(60) Provisional application No. 60/295,667, filed on Jun. 4, 2001.

(51) Int. Cl.[7] ..... B63G 8/08

(52) U.S. Cl. ..... 114/312; 114/337; 440/42

(58) Field of Search ..... 114/312, 313, 114/336, 337, 338, 61.27, 61.29, 61.3; 440/38, 40, 42

(56) References Cited

U.S. PATENT DOCUMENTS

| | | | | |
|---|---|---|---|---|
| 891,214 | A | 6/1908 | Graft et al. | |
| 1,749,087 | A | 3/1930 | Riley | |
| 2,270,690 | A | 1/1942 | Shannahan | 115/14 |
| 2,276,193 | A | 3/1942 | Hanley | 115/14 |
| 2,467,022 | A | 3/1949 | Forlano | 115/16 |
| 2,730,065 | A | 1/1956 | Piper | 115/14 |
| 3,122,121 | A | 2/1964 | Krauth | 115/12 |
| 3,182,623 | A | 5/1965 | Lehmann | 114/16 |
| 3,492,965 | A | 2/1970 | Wayfiled | 115/12 |
| 3,575,127 | A | 4/1971 | Wislicenus et al. | 115/12 |
| 5,574,246 | A | 11/1996 | Meyers et al. | 114/20.2 |
| 6,188,139 | B1 | 2/2001 | Thaxton et al. | 290/4 R |
| 6,203,388 | B1 | 3/2001 | Sinko et al. | 440/6 |
| 6,217,399 | B1 | 4/2001 | Sinko et al. | 440/38 |

*Primary Examiner*—Stephen Avila
(74) *Attorney, Agent, or Firm*—Woodcock Washburn LLP

(57) ABSTRACT

An underwater or submersible vehicle including an elongated body having a substantially ellipsoidal forward section, a substantially cylindrical mid-section, and a tapered aft section having an internal vectored thrust propulsion system for propelling and maneuvering the vehicle through a fluid operating environment. At least two discharge nozzles are located along a horizontal beam on opposite sides of a longitudinal centerline in the aft section for providing differential and/or vectored thrust for propelling and maneuvering the vehicle through the fluid operating environment. The vehicle can also includes at least two backing nozzles capable of one or more of differential and vectored thrust for providing a backing and/or athwartships thrust to slow, stop, reverse, and maneuver the vehicle. The vehicle can also includes secondary thrust-driven propulsion system located in the forward section for providing a secondary differential and/or vectored thrust. In addition, the vehicle can include a stern configuration including a wedge-shaped tapered stern section defining a space that provides an increased volume over conventional conical shaped tapered stern section for wet or dry storage. The vehicle can also include a distributed power generation, distribution, and control system, a modular design, and redundancy for flexibility in the arrangement of machinery and equipment and improved survivability.

41 Claims, 23 Drawing Sheets

Concept- Pump Based SPU/Vectored Thruster

PROPULSION OF UNDERWATER VEHICLES USING DIFFERENTIAL AND VECTORED THRUST

This Application: claims benefit of U.S. provisional Application Serial No. 60/295,667 filed Jun. 4, 2001.

FIELD OF THE INVENTION

The invention relates to the field of fluid-borne vehicles. In particular, the invention concerns the propulsion of underwater or submersible vehicles using a distributed propulsion system having internal propulsors that add hydraulic energy to a fluid flow internal to the vehicle body, at least two discharge nozzles and at least two backing nozzles that are capable of differential and/or vectored thrust for propelling and maneuvering the vehicle in conjunction with conventional control surfaces and having a wedge-shaped stern configuration which provides an increased volume for the storage of ship systems and stores.

BACKGROUND OF THE INVENTION

Conventional underwater vehicles typically consist of either an axi-symmetric central body with a propulsion motor shaft exiting a conical projection at the stern on the centerline or two propulsors and shafting systems mounted on either side of the stern of the vehicle. In both arrangements a shaft drives a propeller that provides ship propulsion thrust. These external propeller systems having long propeller shafts, shaft alleys, reduction gears, and other mechanical support systems are large and expensive.

Conventional underwater vehicles also include jet type propulsion systems. For example, Lehmann (U.S. Pat. No. 3,182,623) discloses a structure for submarine jet propulsion, Wislicenus et al. (U.S. Pat. No. 3,575,127) disclose a vehicle propulsion system for fluid-submerged bodies, such as torpedoes or submarines, and Meyers et al. (U.S. Pat. No. 5,574,246) disclose an underwater vehicle having an improved jet pump propulsion configuration. Each of these jet type propulsion systems basically includes a motor driven pump located inside the vehicle with water being taken in, pressurized, and pumped out near the aft end of the vehicle to form the jet pump propulsion unit. However, these conventional jet type propulsion systems experience limitations with maneuvering the vehicle through the water and with stopping or reversing the vehicle.

For example, Sinko et al. (U.S. Pat. No. 6,217,399 B1) disclose a propulsion arrangement for axi-symmetric fluid-borne vehicles having four propulsion modules that are separate from and external to the hull of the vehicle and that are removably mounted at the rear of the vehicle. The four propulsion modules are in symmetric disposition about the vehicle axis and control vanes are mounted on the module housing at locations between the propulsion modules. However, the propulsion arrangement disclosed by Sinko et al. only provides a rearward discharge of fluid driven by a rotating blade section for the forward movement of the vehicle. As shown, this arrangement does not provide for vectored thrust.

Control surfaces and projections are typically positioned forward of the propeller or jet propulsor. Hence, flow distortions flowing along the exterior of the vehicle in the form of wakes enter the propeller/propulsor causing vibration and/or cavitation. Also, the flow deflected by the control surfaces in a turn is partially re-aligned with the vehicle centerline reducing the effectiveness of the control surfaces. Additional projections/appendages from the axi-symmetric central hull shed wakes that enter the external propeller(s), and cause additional vibration.

Typically, these conventional external propeller systems and conventional jet propulsion units are not capable of differential and/or vectored thrust and therefore require a relatively large turning radius relative to the length of the vehicle. This makes operating in shallow water and tight areas, such as along coastlines and harbors, difficult.

The conical tapered aft section in these conventional vehicles house the shafting and shaft alley for the shaft driven propeller. Accordingly, this conical tapered aft section typically does not provide sufficient space for the storage of wet or dry stores.

The conical shaped aft section of conventional underwater vehicle also make it difficult to access the after most portion of the stern section and also makes it difficult to store and deploy items, such as weapons, sensors, other vehicles, swimmers, and the like, due to the shafting extending through the stern section and the location of the external rotating propellers.

In addition, some conventional vehicles include integrated power distribution arrangements. For example, U.S. Pat. No. 6,188,139 B1, entitled Integrated Marine Power Distribution Arrangement, issued to Thaxton et al., discloses a marine power distribution arrangement including a turbine-driven AC generator which supplies power through a switchgear unit to a transformer and power converter(s) for ship propulsion and ship service loads. However, conventional integrated electric plants typically have the propulsion components located in the primary pressure hull with a shaft or shafts extending through the hull to the external propeller (s) and therefore lack flexibility in the arrangement of the components.

Therefore a need exists for improved propulsion system for an underwater vehicle having differential and/or vectored thrust that provides for forward and reverse propulsion and full maneuverability of the underwater vehicle. The need also exists for an underwater vehicle having a stern configuration that provides an increased volume in the stem section for increased wet and/or dry storage.

SUMMARY OF THE INVENTION

The present invention is directed to an underwater vehicle including an elongated body having a bow, a forward section, a mid-section, an aft section, and a stern. At least one inlet opening in the body for receiving a fluid from an external fluid operating environment into the body. Inlet ducting is connected to the at least one inlet opening, the inlet ducting containing and guiding the fluid as it flows internal to the body. At least one propulsion pump connected to the second end of the inlet ducting, the at least one propulsion pump adding hydraulic energy to the fluid to induce a flow of the fluid though the body. Outlet ducting having a first end and a second end, the first end connected to the at least one propulsion pump, the outlet ducting containing and guiding the fluid as it flows internal to the body. At least two discharge nozzles connected to the second end of the outlet ducting at the aft section, the at least two discharge nozzles positioned in a laterally spaced apart relationship along a horizontal beam of the body on opposite sides of a longitudinal centerline axis.

The number and exact location of the inlet duct, pumps, discharge nozzles, controlling surfaces, etc. can be varied by a person of ordinary skill in the art to meet common design specifications.

The at least two discharge nozzles provide propulsive thrust to propel the vehicle through the fluid operating environment. In addition, the at least two discharge nozzles are capable of producing one or more of a differential thrust and a vectored thrust to maneuver the vehicle through the fluid operating environment.

Differential thrust may be provided by changing the volume of fluid flowing to each of the at least two discharge nozzles. The at least two propulsion pumps each having a variable speed power source for driving each of the at least two propulsion pumps at differential speeds can be used to drive a differential flow of fluid to the at least two laterally spaced apart discharge nozzles that produce differential thrust to propel and maneuver the vehicle through the fluid operating environment. Alternatively, a diverter plate can be used, with one or more pumps, to divert a portion of the fluid flowing to the at least two discharge nozzles.

Vectored thrust may be provided by changing the discharge angle from the longitudinal centerline at which the fluid flow exiting each of the at least two discharge nozzles. During normal ahead operations, the discharge nozzles discharge a fluid flow in a normally rearward direction to propel the vehicle in a forward direction. During maneuvering, the discharge nozzles can be moved, preferably in multiple degrees of freedom, to produce vectored thrust.

Preferably, the discharge angle of the fluid flow exiting the discharge nozzles is vectorable in at least two directions including a horizontal direction and a vertical direction to produce a vectored thrust in a yaw plane for turning to port and starboard and a pitch plane for diving and ascending. In addition, the discharge nozzles are preferably independently vectorable allowing independent selection of thrust vectoring at least two directions to further control yaw, pitch, and roll of the vehicle.

A vectored thrust actuator system can be used to move each of the discharge nozzles. According to one embodiment of the invention, the vectored thrust actuator system can include at least one yaw actuator coupled to one side of each of the discharge nozzles for moving the discharge nozzle in a horizontal plane and at least one pitch actuator couple to one of a top and bottom of each of the discharge nozzles for moving the discharge nozzle in a vertical plane. Other means of altering the discharge angles of the discharge nozzles, such as flexible couplings, movable vanes, a variable geometry or articulated nozzle, etc. can be used.

According to another aspect of the invention, the underwater vehicle of claim 1 further includes a backing, reversing, and stopping capability. At least two backing nozzles that are selectively fluidly connected to an outlet of one or more of the at least one propulsion pumps for producing a backing thrust to slow a forward motion of the vehicle and to propel the vehicle generally in a backward axial direction.

The backing nozzles discharge a flow of fluid in a normal direction that is generally forward toward the forward section and wherein the backing nozzles are preferably vectorable in at least two directions comprising a fore and athwartship direction and a vertical direction to produce a vectored thrust to further assist with propelling and maneuvering the vehicle. Preferably, the backing nozzles are independently vectorable in the at least two directions to control yaw, pitch, and roll of the vehicle.

A backing door can be provided for selectively diverting a flow of the fluid exiting the propulsion pump to one of the discharge nozzles and the backing nozzles. A backing door actuator system moves the backing door between a first position where flow to the backing nozzles is closed off and a second position where flow is diverted to a backing duct that guides the fluid to the backing nozzles. The backing door can be moved between a first position wherein the flow diverter device closes off the backing ducting and the flow of fluid exiting the propulsion pump flows to the discharge nozzles, and a second position wherein the flow diverter device opens the backing ducting and the flow of fluid exiting the fluid propulsor flows to the backing nozzles.

Preferably, the inlet openings are positioned in the body to minimize or exclude one or more of surface and bottom debris, air, and turbulence resulting from external protrusions from the body from entering the inlet openings.

According to one aspect of the invention, the at least one inlet opening includes two partial annular inlet openings positioned symmetrically with one partial annular inlet opening on a port side and one partial annular inlet opening a starboard side of a forward end of the aft section. According to another aspect of the invention, the at least one inlet opening comprises a partial annular inlet opening that extends over approximately three quarters of a circumference of the body from the port side across a bottom to the starboard side.

The underwater vehicle of claim 1, wherein each of the at least one propulsion pump comprises a double suction mixed flow pump having a motor directly coupled and adjacent to the pump.

A pair of faired discharge ducts extending outward and rearward from the aft section of the body can be used to house the discharge nozzles. Also, a portion of the outlet ducting can extend through each faired discharge duct to the discharge nozzles located at a distal end of each of the faired discharge ducts.

Furthermore, the underwater vehicle can include one or more control surfaces to farther facilitate maneuverability of the vehicle. For example, the vehicle can include one or more vertical control surfaces extending in a vertical plane from the aft section and/or one or more horizontal control surfaces extending in a horizontal plane from the aft section. Vertical control surfaces further facilitate maneuvering of the vehicle on a yaw plane and horizontal control surface further facilitate maneuvering of the vehicle on a pitch plane.

In accordance with another aspect of the invention, the underwater vehicle can further include a secondary thrust-driven propulsion system. The secondary thrust-driven propulsion system includes at least one secondary inlet opening in the body, secondary inlet ducting connected to the secondary inlet opening for guiding a flow of fluid therethrough, at least one secondary propulsion pump connected to the secondary inlet ducting for adding hydraulic energy to a fluid to drive the fluid through the secondary thrust-driven propulsion system, secondary outlet ducting connected to the secondary propulsion pump for guiding a flow of fluid therethrough, and at least two secondary discharge nozzles connected to the bow outlet ducting for discharging the fluid being driven by the at least one secondary propulsion pump. The at least two secondary discharge nozzles are disposed in a laterally spaced apart relationship with one secondary discharge nozzle being position on a port side of the vehicle body and one secondary discharge nozzle being positioned on a starboard side of the vehicle body. The secondary thrust-driven propulsion system can be used to produce one or more of a differential thrust and a vectored thrust to further assist in propelling and/or maneuvering the vehicle.

According to another aspect of the present invention, the underwater vehicle can include a distributed power generation, distribution, and control system for providing power to and control of the thrust-driven propulsion system. The distributed power generation, distribution, and control system includes at least one power source located in a primary pressure hull of the body, a plurality of turbo-generators located in a primary pressure hull of the body for converting a power output from the power source to electrical energy, controllers and a bus system located in a primary pressure hull of the body for controlling the distribution of electrical energy, at least one propulsion driver located in either the primary pressure hull or a fairing extending aft from the primary pressure hull at the aft section of the body, and at least one propulsion pump located in the fairing, the at least one propulsion pump being coupled to the at least one propulsion driver. This type of propulsion system having distributed, modular components results in the flexible arrangement and interconnectability of the power generation, distribution, and control.

The present invention is also directed to an underwater vehicle having a wedge shaped stern configuration. The underwater vehicle includes a bow, a stem, an ellipsoidal bow section, a cylindrical central section, and a wedge shaped fairing. The wedge shaped fairing includes a substantially constant width and tapering smoothly from a first cylindrical end connected to the central section to a second end forming a horizontal edge at the aft distal end of the body. The wedge shaped stern section defining a space having an increased volume at the stern for housing additional ship systems and stores.

The wedge shaped fairing further includes an upper tapered surface, a lower tapered surface, port and starboard sidewalls, and the horizontal edge. The upper tapered surface tapers downward heading aft from the first end to the second end. The lower tapered surface that tapers upward heading aft from the first end to the second end. The port and starboard sidewalls are disposed between and connect the upper tapered surface to the lower tapered surface. The horizontal edge is formed along a horizontal beam where the upper tapered surface to the lower tapered surface meet at the aft distal end of the body.

In addition, one or more trunks or passageways can be provided extending through the space defined by the wedge-shaped fairing. Preferably, the trunk(s) are pressurized from a primary pressure hull of the vehicle. The trunk includes an opening between the trunk and a fluid operating environment in which the vehicle operates. A trunk door covers the opening and selectively opens and closes the trunk opening in order to dispense and/or retrieve devices from the stern of the vehicle.

The underwater vehicle having a wedge shaped fairing can include a thrust-driven propulsion system as described above. Preferably, the propulsion pumps, outlet ducting, and at least two discharge nozzles are located in the space defined by the wedge shaped fairing. In addition, one or more of a control system and an actuator system may be located in the trunk.

The underwater vehicle having a thrust-driven propulsion system can include two or more alternative stern configurations. In a first exemplary embodiment, the underwater vehicle can include a stern configuration including a tapered aft conical stern section having at least two faired discharge ducts that extend outward and rearward from the stern section and include portions of the outlet ducts and the discharge nozzles. The faired discharge ducts allow the discharge nozzles to be positioned in a laterally spaced apart relationship on opposite side of the longitudinal axis of the vehicle.

In a second exemplary embodiment, the underwater vehicle can include a stern configuration including a wedge shaped fairing that provides a space and covering in which portions of the thrust-driven propulsion system, including the at least two discharge nozzles, can be positioned.

The present invention is also directed to a method for propelling and maneuvering an underwater vehicle through a fluid operating environment. The method includes providing a body having an ellipsoidal shaped bow section, a cylindrical mid-ship section, and a stern section; ingesting fluid from the operating environment into the body through one or more inlet openings; guiding the fluid through the body through internal ducts; driving the fluid through the ducts using one or more pumps to add hydraulic energy to the fluid passing through the ducts; propelling the body through the fluid operating environment by discharging the fluid exiting from the pumps through at least two discharge nozzles positioned at the stern section in a laterally spaced apart relationship along a horizontal beam on opposite side of a longitudinal centerline of the body; and maneuvering the body through the fluid operating environment by controlling one of a magnitude and a direction of the fluid being discharged from the body thereby producing one or more of a differential and a vectored thrust.

In accordance with another aspect of the invention, the method further includes varying the speed of a power source used to drive the pumps to produce differential thrust for controlling one or more of yaw, pitch, and roll of the vehicle.

In accordance with another aspect of the invention, the method further includes moving the discharge nozzles in at least two dimensions to produce vectored thrust in multiple degrees of freedom for controlling one or more of yaw, pitch, and roll of the vehicle.

The method can further include diverting the fluid exiting the one or more pumps to at least two backing nozzles positioned at the stern section in a laterally spaced apart relationship with at least one backing nozzle being positioned along a port side and at least one backing nozzle being positioned along a starboard side of the body to provide a backing thrust; reversing and/or stopping the body by discharging the fluid exiting from the pumps through at least two backing nozzles; and maneuvering the body through the fluid operating environment by controlling one of a magnitude and a direction of the fluid being discharged from the body thereby producing one or more of a differential and a vectored thrust.

Furthermore, the method can include providing a secondary thrust-driven propulsion system in the bow section of the body; ingesting fluid through at least one secondary inlet opening in the body; driving the ingested fluid using one or more secondary pumps connected to the secondary inlet ducting; discharging the driven fluid through at least two secondary discharge nozzles connected to the secondary pumps to produce a secondary thrust, the at least two secondary discharge nozzles being disposed in a laterally spaced apart relationship with one secondary discharge nozzle being position on a port side of the vehicle body and one secondary discharge nozzle being positioned on a starboard side of the vehicle body; and producing one or more of a differential thrust and a vectored thrust by controlling a magnitude and a direction of the fluid flow being discharged through the secondary discharge nozzles.

Additional features of the present invention are set forth below.

DETAILED DESCRIPTION OF THE PREFERRED EMBODIMENTS

In the illustrated embodiments of the invention shown in FIGS. 1–21B, an underwater or submersible vehicle 1 is shown having an internal thrust-driven propulsion system 20 capable of producing differential and/or vectored thrust for propelling and maneuvering the vehicle 1 through a fluid operating environment 2. Preferably, the internal thrust-driven propulsion system 20 is also capable of producing a backing and/or athwartship vectored thrust for reversing and maneuvering the vehicle 1. In addition, the vehicle 1 also includes a wedge shaped fairing 70 at the stern that provides an increased volume as compared to conventional vehicles having a conical shaped stern section.

General Description

Figure 1:
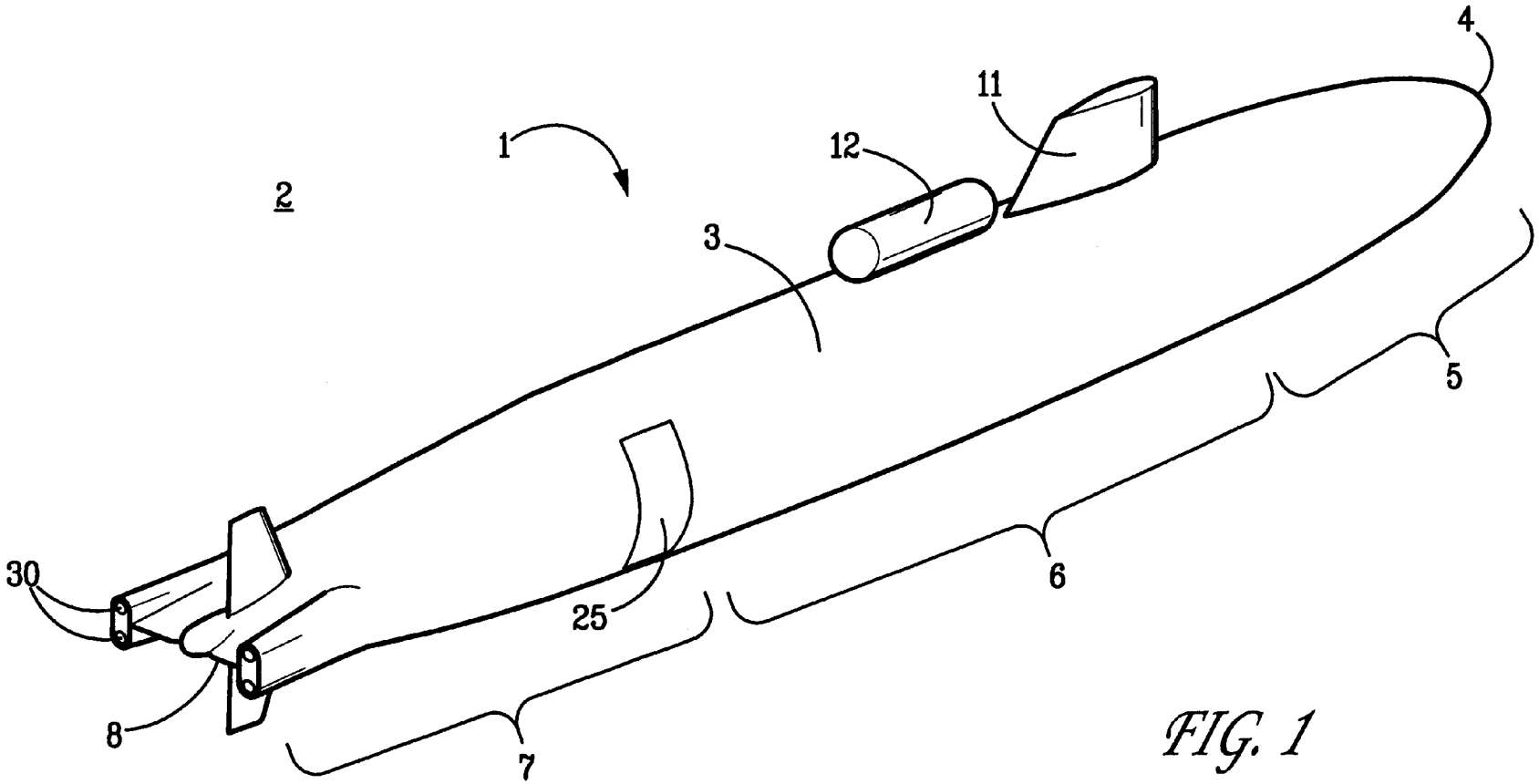
FIG. 1 shows an exemplary underwater vehicle.
Figure 2:
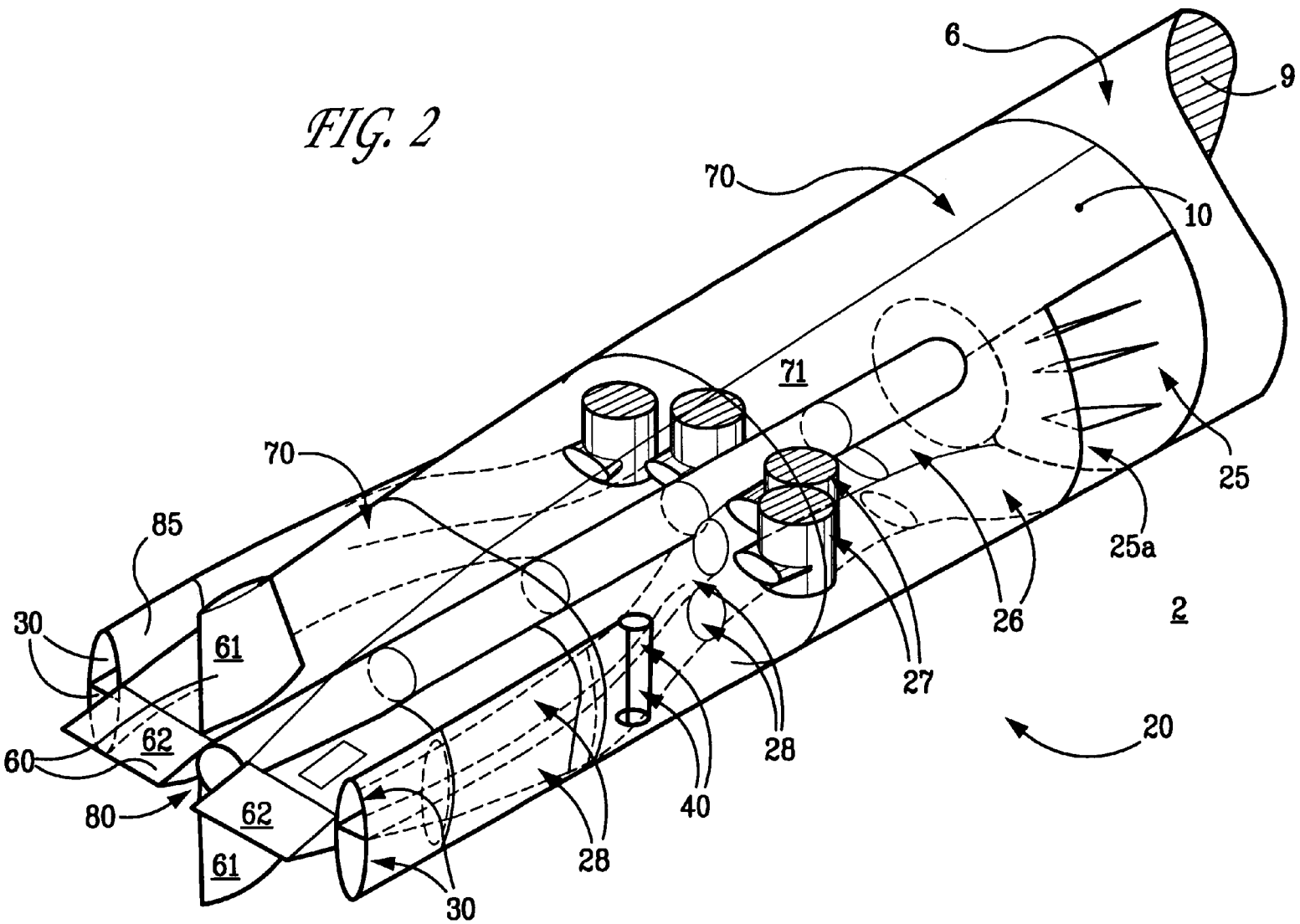
FIG. 2 shows a partial sectional view of an embodiment of an internal thrust-driven propulsion system that can be used with an underwater vehicle.

FIGS. 1 and 2 show an exemplary underwater vehicle 1, such as a submarine, having an internal thrust-driven propulsion system 20 capable of producing a forward and backing thrust and a wedge shaped fairing 70. As shown in FIG. 1, the vehicle 1 includes an elongated body or hull 3 having a bow 4, a forward or bow section 5, a central or mid-ship section 6, a stern or aft section 7, and a stern 8. As illustrated, the body 3 has an ellipsoidal bow section 5, cylindrical mid-ship section 6, and a wedge-shaped fairing 70 at the stern section 7. The body or hull 3 defines an outer boundary between the inside of the vehicle 1 and the fluid operating environment 2.

As shown in FIGS. 1 and 2, the body 3 further includes a pressure hull 9, including generally the forward section 5 and the central section 6, containing, for example, the power generation systems, personnel, and critical components. The stern section 7 is connected to the aft end of the central section and is aft of an "aft-hemi-head" or watertight bulkhead 10 that separates the pressure hull 9 from the space 71 defined by the wedge shaped fairing 70. The stern section 7 can encompass a ballast tank used to control the buoyancy of the aft portions of the submerged vehicle 1. The forward section 5 and central section 6 of the hull may have various appendages and protrusions (11, 12), typically on the topmost portion of the hull body 3.

The thrust-driven propulsion system 20 provides the ability to change the magnitude and/or direction of the thrust produced by the propulsion system in at least two directions provides multiple degrees-of-freedom thrust vectoring that provides full maneuverability of the vehicle 1. This type of thrust-driven propulsion system 20 also allows the vehicle 1 to maneuver at low speeds and in shallow waters with or without the use of traditional control surfaces. Traditional control surfaces 60, such as, for example, rudders, pitch planes, and the like, can be retained as an option in certain embodiments of the invention and provide improved maneuvering, especially at higher speeds.

While conventional submarine propulsion systems typically consist of a single main motor or engine contained within the pressure hull, a single shaft penetrating the vehicle pressure hull, and a single propulsion device such as a propeller or pumpjet propulsor, the improved thrust-driven propulsion system 20 can be a distributed propulsion system. The distributed thrust-driven propulsion system 20 preferably includes a multiplicity of fluid inlets 25, propulsion pumps 27, fluid ducts 26 and 28, vectored thrust nozzles 30 and backing thrust nozzles 40. A distributed thrust-driven propulsion system 20 allows for flexibility in the arrangement of the system components as compared to conventional shaft-driven propeller type propulsion systems. A distributed thrust-driven propulsion system also provides for built-in redundancy, thereby improving survivability and allowing operational capability with portions of the system not operating. Also, the underwater thrust-driven vehicle 1 preferably includes a modular design, thereby allowing components to be removed and replaced without affecting other structures or systems. These multiple components can be of smaller size than a single unit thereby facilitating acquisition, logistics, and maintenance.

The vehicle 1 can also include an improved stern configuration. Preferably, the stern configuration includes a wedge shaped fairing 70 that results in a space 71 having an increased volume at the stern section 7 of the vehicle 1 relative to conventional conical shaped stern sections. This space 71 can be a dry space for the storage of machinery, weapons, sensors, and the like, or a wet space for the storage of ballast, potable water, fuel, and the like. The propulsion pumps 27 are located internal to the vehicle body 3, preferably in the wedge shaped fairing 70. This eliminates the need for expensive and maintenance intensive shaft seals and bearings. In addition, without the presence of the external rotating propulsor components, the possibility of damage to aft launch vehicles and breakage of the wire connection of wire-guided vehicles is eliminated. In addition, internally mounted propulsors are inherently very beneficial and safe for swimmers in the water.

The distributed thrust-driven propulsion system 20 allows for a non-centerline arrangement of the propulsion system. This configuration allows for the possibility of one or more watertight trunks or passageways 80 extending through the wedged shaped fairing 70. The trunk 80 may extend through the wedged shaped fairing 70 from the primary pressure hull 9 to an opening at the aft end or stern 8 of the vehicle 1. This trunk 80 can be used to provide a close-coupled air connection to external pump motors and controllers, thrust vectoring actuator systems, control surface actuator systems, control systems, and the like. The trunk 80 avoids the need for a pressure compensation system in the external pump motor and reduces the length of control surface linkages with traditional internal actuator systems. The trunk 80 can also be used to house or store aft facing sensors or launching underwater unmanned vehicles (UUVs), swimmers, countermeasures, etc.

In addition to a submarine, the vehicle 1 can also include other types of underwater or submersible vehicles, such as, for example, a torpedo, an unmanned underwater vehicle (UUV), a remotely operated vehicle (ROV), a autonomous underwater vehicle (AUV), and the like. In addition, the vectored thrust propulsion unit can be used with surface vessels powered by a vectored thrust propulsion unit located submersed below the waterline. For example, the vehicle can include a surface vessel such as, for example, a hydrofoil craft having pods that are submersed during operation, wherein the pods house the multiple degrees of freedom vectored thrust propulsion system.

Propulsion System

FIGS. 2–11 show several exemplary embodiments of internal thrust-driven propulsion systems for underwater or submersible vehicles. Generally, in the illustrated embodiments the internal thrust-driven propulsion systems 10 include one or more fluid propulsors 21 each having an inlet section 22, a fluid pumping or driving section 23, and an outlet section 24. The inlet section 22 receives a fluid from the outside fluid operating environment 2 and contains and guides the fluid through the vehicle's body 3 to the fluid pumping section 23. The fluid pumping section 23 located internal to the body 3 of the vehicle 1 imparts hydraulic energy to the fluid passing therethrough and drives the fluid toward the outlet section 24. The outlet section 24 discharges the fluid from within the body 3 back to the outside operating environment 2 thereby propelling the vehicle 1 through the fluid 2.

The magnitude of the high-energy discharge stream can be controlled, for example, by varying the speed of propulsion pumps discharging on opposite sides of the vehicle to control the differential thrust generated thereby assisting the maneuvering of the vehicle 1 through the fluid 2. In addition, the direction of the high-energy discharge stream exiting the outlet section 24 can be vectored so that the discharge stream exits at an angle θ to the longitudinal centerline axis CL of the vehicle 1 to maneuver the vehicle 1 through the fluid 2. The thrust-driven propulsion system 20 can control the magnitude, the direction, or both the magnitude and direction of the fluid discharge stream exiting the fluid propulsors 21.

As shown, the fluid propulsors 21 can be located within the stern section 7 of the vehicle 1. Alternatively, portions of the fluid propulsors 21 may be located in other areas of the vehicle body 3, such as, for example, the inlet section 22 may be located in the bow section 5 and/or the fluid pumping section 23 may be located in the mid-ships section 6, depending on the particular application. In addition, one or more secondary thrust-driven propulsion systems 50 can be provided at various locations throughout the vehicle body 3 to further facilitate propelling and maneuvering the vehicle 1.

Each of the illustrated embodiments include at least one inlet opening 25, at least one inlet duct 26, at least one propulsion pump 27, at lease one outlet duct 28, and at least two discharge nozzles 30. In order to achieve the desired effect of providing differential and/or vectored thrust for propelling and maneuvering the vehicle 1 through the fluid 6, the at least two discharge nozzles 30 are disposed in a laterally spaced apart relationship relative to the horizontal beam (e.g., X-axis) of the vehicle 1 and on opposite side of a longitudinal centerline CL of the vehicle 1.

Preferably, the discharge nozzles 30 are located at a maximum lateral distance L apart in order to maximize the maneuvering moment obtainable using differential and/or vectored thrust. At the same time, it is desirable to keep the distance L between the discharge nozzles 30 within the beam or width of the vehicle 1 for docking and ship handling operations.

Propulsion System Component Description

Each of the major features or components of the thrust-driven propulsion system 20 is described generally below. Specific reference to each feature can be found in the various embodiments of the thrust-driven propulsion system 20 and are shown and described with reference to the FIGS. 2–11.

Inlet Opening

At least one inlet opening 25 in the body 3 of the vehicle 1 is provided to convey fluid from the external operating environment 2 and into the inside of the vehicle's body 3. The fluid passes from the operating environment 2 through the inlet opening 25 into the internal portion of the vehicle's body 3 where internal ducts 26 contain and guide the fluid within the body 3.

The function of the inlet opening 25 is to ingest a volume of fluid flow required to generate thrust. The degree of flow volume that can be ingested by an inlet opening 25 is related to the inlet opening's angular dimension around the vehicle hull and the length of the inlet opening along the hull.

Preferably, the inlet opening 25 has a smooth transition from the cylindrical central portion 4 of the submarine hull 2. Fluid from the submarine hull boundary layer is ingested into the fluid propulsor 21. Inflow control vanes (not shown) and shaped inlet edges 17 are preferably provided to ensure that smooth flow is maintained.

The vehicle 1 can include different embodiments having different numbers of inlet openings 25 depending on the required fluid volume to be ingested. In addition, the inlet opening(s) 25 may include a variety of shapes and sizes depending on the particular application and the performance requirements of the vehicle 1.

Preferably, the arrangement of the system, specifically the location and extent of inlet openings 25, allows the external configuration of the vehicle 1 to be altered without affecting the quality of flow entering the propulsion pumps 27.

In addition, the inlet openings 25 are preferably located and constructed to minimize or prevent the introduction of foreign objects, such as air and sediment. Multiple inlet openings 25 can be provided, such as a top opening, side openings, and bottom openings. Preferably, where a top or bottom opening are used, the top opening can be secured when the vehicle 1 is operating near the surface of the fluid and the bottom opening can be secured when the vehicle 1 is operating near the bottom of the fluid.

Inlet Ducting

Internal inlet ducting 26 connects the inlet opening 25 to an inlet of the propulsion pump 27. Fluid entering the body 3 through the inlet opening 25 flows into the inlet duct 26, which contains and guides the fluid to propulsion pump 27. The inlet ducting 26 includes a first end 26*a* connected to the inlet opening 25 and a second end 26*b* connected to the inlet of the propulsion pump 27. Preferably, the inlet ducts 26 are designed to maintain a smooth flow, and to condition the fluid flow to minimize vibration and cavitation in the pumps. The internal ducting 26 is preferably constructed to provide a substantially uniform velocity profile of the fluid flowing therein.

A screening/filtering device (not shown) can be provided to further minimize the ingestion of foreign objects. For example, a screen can be provided over the inlet opening 25 to prevent foreign objects from entering the inlet ducting, or a strainer/filter can be disposed in the inlet duct 26 to filter out any debris from the fluid before it enters the Propulsion pump 27.

Means of Generating Thrust

In order to propel a submarine vehicle 1, thrust is generated to overcome the (drag of the vehicle produced by its movement through the fluid medium. Conventional underwater vehicles typically have an external propeller or pump-jet propulsor that accomplishes the change in energy and produces a flow that is used to produce thrust that is external to the submarine vehicle. With the present invention, a pump is used to increase the energy of the fluid flow contained internal to the vehicle within ducting. Thrust is generated by adding energy to the ingested fluid medium and expelling the fluid at a higher velocity than the velocity of fluid when ingested.

A method of generating thrust is to increase the pressure of the ingested fluid and then to expel the fluid through an accelerating nozzle, resulting in a change in the fluid momentum. The thrust is then proportional to the change in momentum and the rate of ingested fluid flow.

Propulsion Pumps

Propulsion pumps 27 are connected to the inlet duct 26 and draws fluid from the fluid operating environment 2 through the inlet opening 25 and drive the fluid out through the discharge nozzles 30 thereby producing thrust to propel the vehicle 1. Each propulsion pump 27 includes a pump inlet, a pump outlet, and a set of rotating blades or vanes that impart energy to the fluid flowing through the fluid propulsor 21.

The propulsion pump 27 can include a variety of pumps, including, for example, axial flow, mixed flow, and radial flow pumps, depending on the rate of fluid flow and the amount of energy that must be added to provide the required thrust. To generate a given degree of thrust, mixed and radial flow pumps require less fluid flow rate than a propeller or axial flow pump, but add more energy or pressure rise to the fluid flow. Using mixed or radial flow pumps typically result in smaller pumps and a smaller cross section area for the fluid flow ducts than an axial flow pump generating the same degree of thrust.

In one embodiment, the propulsion pump 27 can include relatively compact double suction pumps located back to back such that the thrust generated by each pump is reduced/canceled out by its opposite pump rotor with resulting vibration from the pump operation being reduced or canceled out. Preferably, the flow velocity of the fluid flowing internally through the ducting has a flow velocity that is lower than the velocity of the vehicle through the fluid operating environment. For example, the flow velocity of the fluid in the internal ducting can be about 80% of the vehicle's velocity that results in pump vibration being minimized.

Differential Thrust

Preferably, the thrust-driven propulsion system 20 is capable of producing differential thrust between the at least two discharge nozzles 30. Differential thrust further assists with the maneuverability of the underwater vehicle 1 by helping to create a turning moment caused by a difference in the magnitude of the thrust being produced at the laterally spaced apart discharge nozzles 30. The location of the pumps, flow jets, or fluid ejectors and the capability of providing differential thrust further enhances maneuvering, compared to a single, central propulsor, or non-vectorable thrust type propulsion unit.

Any suitable technique for generating differential thrust can be used. In one embodiment, thrust can be generated using variable speed pumps to adjust the flow output from two or more pumps located on opposing sides of the vehicle centerline. In an alternate embodiment, a diverter or movable plate (not shown) can be positioned in the outlet flow from the pumps to diverter a portion of the discharging flow away from the discharge nozzles 30 so that the thrust produced by each discharge nozzle 30 can vary thereby producing a different thrust at each of the laterally spaced-apart discharge nozzles 30.

Propulsion Pump Power Source

Each propulsion pump 27 can be powered using conventional power techniques. For example, the fluid propulsor power source 15 can include an electrical or mechanical driver, such as an electric motor. These electric motors 15 can be mounted in canisters coincident with the pumps or in the forward portions of the vehicle (e.g., within the pressure hull 9) and can be connected to the pumps by means of, for example, mechanical drive shafts.

Figure 20:
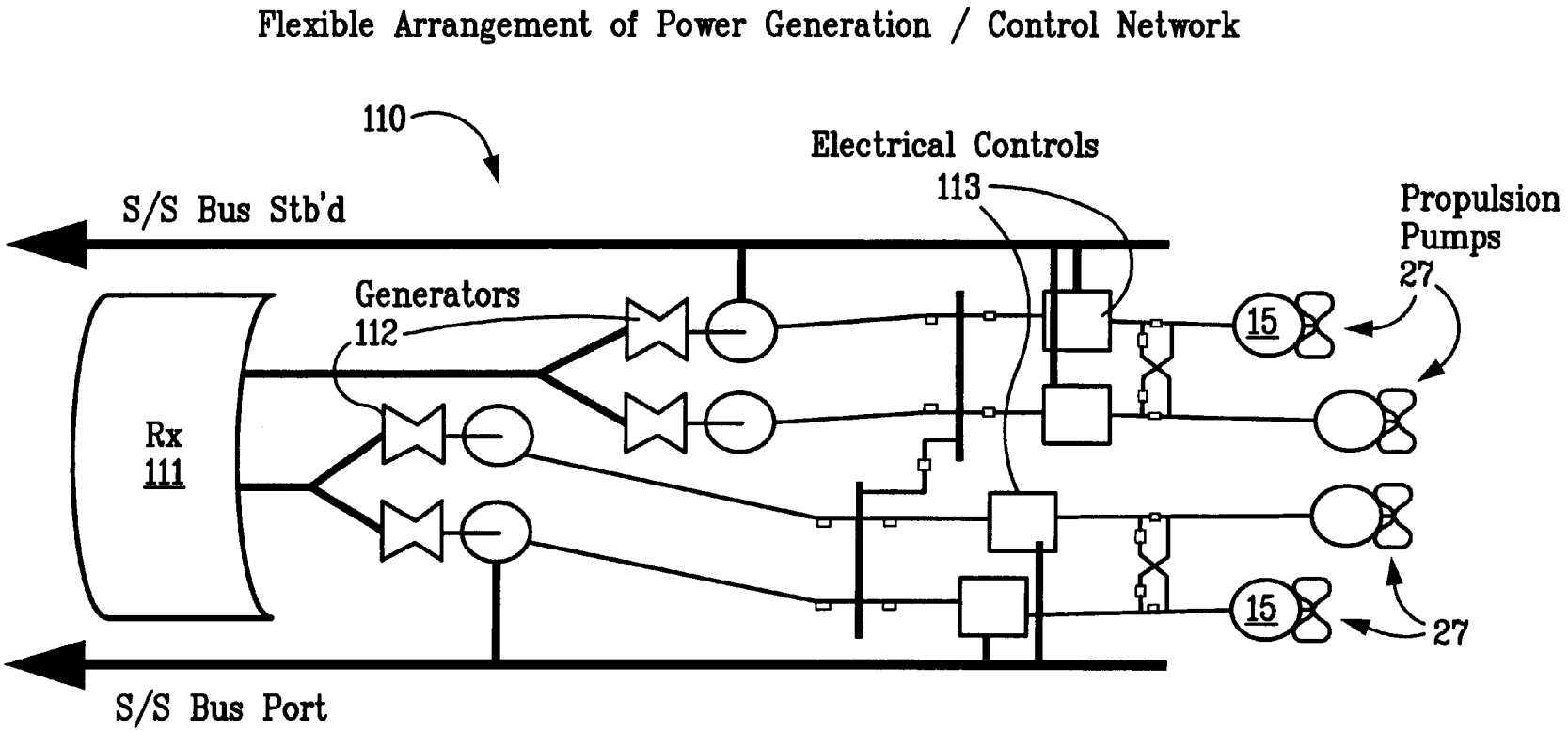
FIG. 20 shows an exemplary distributed power generation, distribution, and control system that provides improved flexibility in the arrangement of the machinery and equipment within the underwater vehicle.
Figures 21A, 21B:
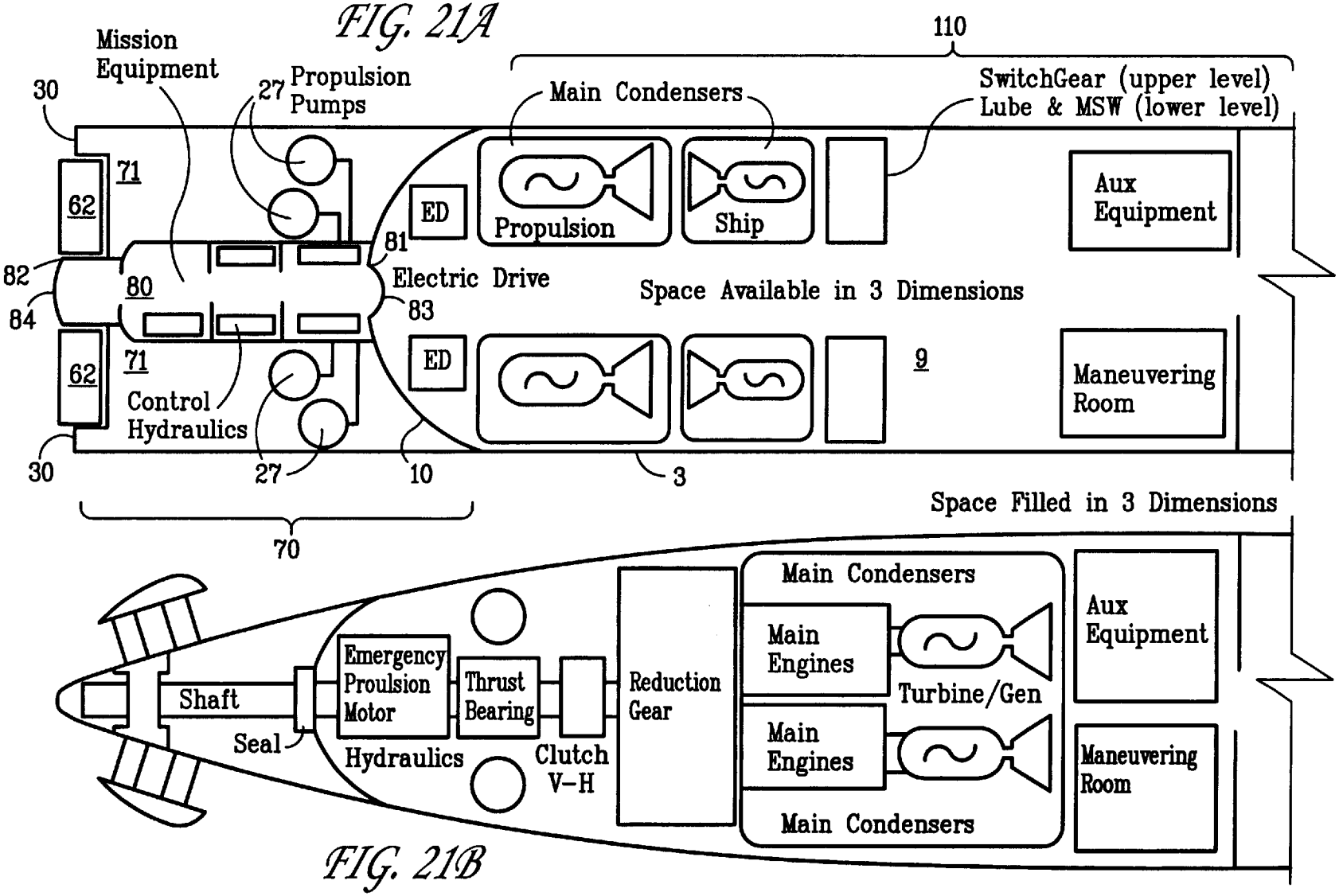
FIGS. 21A and 21B show a comparison of an exemplary distributed vectored thrust propulsion system of FIG. 19 and a conventional single shaft propulsion system having an external rotating propeller.

The propulsion pump power source 15 can in turn receive power from the main propulsion plant power source 16 (see FIGS. 20 and 21B). The main propulsion plant power source 16 can include an electrical, mechanical, chemical (e.g., battery), nuclear, fuel cells, solid propellants that use water as an oxidizer, liquid propellants, and the like.

Outlet Ducting

Outlet ducting or pump discharge ducts 28 connect an outlet of each propulsion pump 27 to one or more of the discharge nozzles 30. The outlet ducting 28 includes a first end 28*a* connected to the outlet of the propulsion pumps 27 and a second end 28*b* connected to the discharge nozzles 30. The outlet ducting 28 transfers high-pressure fluid flow from the discharge of the propulsion pumps 27 through the aft portion of the stem section 7 and to the thrust nozzles 30 located proximate to the stern 8. The ducts 28 are preferably designed for smooth flow and to minimize pressure losses due to friction and area changes.

In embodiments where the number of discharge nozzles 30 exceeds the number of propulsion pumps 27, one or more flow splitters 29 are disposed at the outlet of the propulsion pumps 27 or in the outlet duct 28 to split the fluid flow exiting the propulsion pump 27. The pump discharge ducts 28 continue to the stern 8 of the submarine vehicle. In an aftermost region of the discharge ducts, flow is accelerated and transitioned into the thrust nozzles 30.

The outlet ducting 28 can also includes one or more branches or backing ducts 41 that come off of the primary outlet ducting and that can deliver flow to the backing nozzles 40. Backing doors 42 can be used to divert the discharge flow from the primary discharge ducts 28 to the backing nozzles 40 on the starboard and port beams of the stern section 7. The discharge ducts 28 are designed and positioned to facilitate the contemplated uses and locations of the thrust nozzles 30 and backing nozzles 40.

Discharge Nozzles

At least two discharge nozzles 30 are located in the stern section 7 on opposite sides of the longitudinal centerline CL of the vehicle 1 and discharge the fluid at a high velocity from the vehicle body 3 thereby producing thrust that propels the vehicle 1 through the fluid operating environment 2. The thrust nozzles 30 accelerate the fluid flow from the propulsion pumps 27 and convert the high-pressure flow to high velocity flow. The resulting change in fluid momentum is related to the thrust generated by the propulsion system.

The discharge nozzles 30 can include any conventional type nozzle, such as, for example, a rotating type discharge nozzle having an oval duct construction, a linear type discharge nozzle, and the like.

Preferably, the discharge nozzles 30 are located on the horizontal beam at the aft end proximate the port and starboard sides of the stern section 7 proximate the stern 8 of the vehicle 1. The horizontal or lateral separation of the nozzles between the starboard and port sides is related to the degree of maneuvering control that can be obtained using differential and/or vectored thrust. To improve the degree of maneuverability, the thrust nozzles 30 on each side of the stern 8 are preferably separated by the maximum obtainable width or side to side dimension, typically the beam of the vehicle 1, in order to maximize the maneuvering moment that can be obtained using differential thrust and/or vectored thrust.

In addition, the discharge nozzles 30 can be arranged proximate one or more control surfaces 60 to further assist in the maneuvering of the vehicle 1. For example, the discharge nozzles 30 may be position forward of one or more of a vertical control surface 61 and above and/or below a horizontal control surface 62 in order to provide improved response and maneuverability. Linear nozzles have the advantage of providing additional control surface effectiveness as the position of the control surface is changed.

In the normal (non-vectoring) position, the discharge nozzles 30 discharge flow generally in the backward axial direction in a direction substantially parallel to the longitudinal center axis CL of the vehicle 1 and in the direction aft of the stern 8 producing thrust to propel the vehicle 1 in the forward direction.

Exemplary Embodiments of the Thrust-Driven Propulsion System

The following description of FIGS. 2–7 is provided to further assist in an understanding of the various embodiments of the thrust-driven propulsion system 20 contemplated to be within the scope of the present invention. These examples are illustrative only and are not intended to limit the scope of the present invention.

FIG. 2 shows one preferred embodiment of an underwater vehicle 1 having a thrust-driven propulsion system 20 including a port and starboard fluid propulsor 21. Each fluid propulsor 21 includes a partial annular fluid inlet 25, inlet ducting 26, two propulsion pumps 27, discharge ducting 28, and two discharge nozzles 30. As shown in FIG. 2, two inlets 25 are located aft of the cylindrical hull section and are located symmetrically about the longitudinal centerline CL, one on the starboard side (shown) and one on the port side (not shown).

The position of the partial annular inlets 25 on the port and starboard side of the vehicle 1, as shown in the embodiment of FIG. 2, helps to exclude turbulent flow from appendages and protrusions located on the topmost portion of the forward sections of the submarine hull. In addition, this inlet configuration also helps to exclude ingesting air while the submarine vehicle is operated on the surface of a fluid, and to exclude debris while the vehicle operates near the bottom surface of the fluid region.

FIG. 2 shows the ingested fluid flow through the inlet ducting 26 on the starboard side fluid propulsor 21 being split into two nearly equal flow paths and conveyed into two propulsion pumps 27. A similar fluid ducting system provides fluid flow to two propulsion pumps located in the port side fluid propulsor of the submarine vehicle 1.

FIG. 2 shows four double suction mixed flow pumps 27. As shown in FIG. 2 the propulsion pumps 27 are combined with a motor or engine 15 directly coupled and adjacent to the pump elements. This eliminates the need to have a propulsion shaft extending forward into the pressure hull 9 as well as shaft bearings and pressure seals. Since each of the four propulsion pumps 27 is provided with a separate motor or engine 15, different degrees of power and hence thrust can be obtained from each of the four propulsion pumps 27. This differential thrust can be used to assist in the maneuvering of the vehicle 1 in the ahead and the backing directions.

As shown in FIG. 2, each pump 27 drives the fluid flow through a discharge duct 28 to the discharge nozzles 30. As shown, there are two pairs of stacked discharge nozzles 30, one starboard pair and one port pair.

Figure 3:
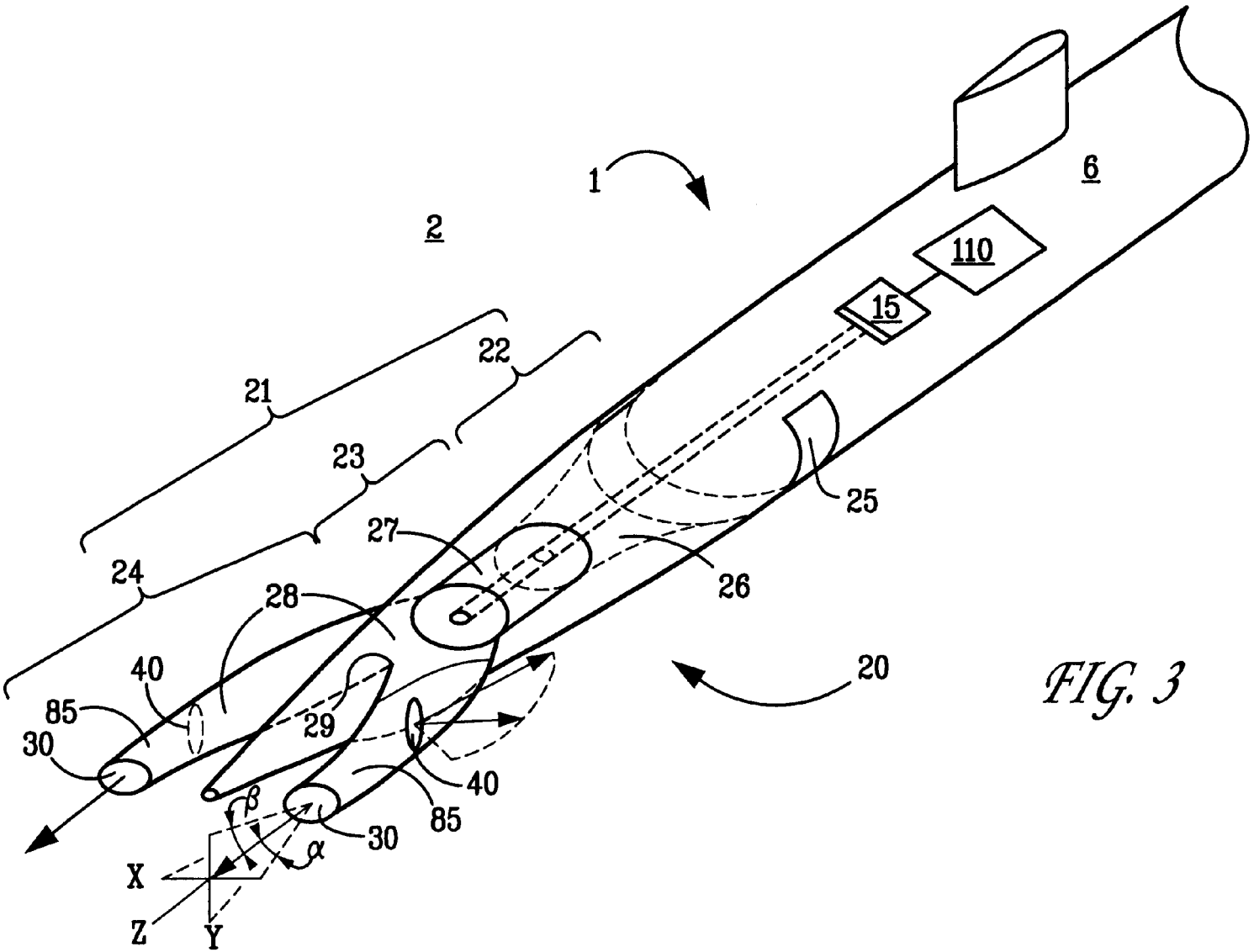
FIG. 3 shows a partial sectional view of another exemplary thrust-driven propulsion system.

FIG. 3 shows an exemplary thrust-driven propulsion system 20 having an inlet 25, an inlet duct 26, a single pump 27, a discharge duct 28, and two discharge nozzles 30. The single partial annular inlet 25 extends over approximately ¾ (e.g., a circumferential arc of approximately 270 degrees) of the circumference of the body 3. As shown, the inlet 25 extends from the starboard side, across the bottom, to the port side of the body 3. The partial annular inlet shown in FIG. 3 is located to eliminate ingestion of turbulence from appendages and structures located on the top of the submarine vehicle. The pump inlet duct 26 is designed to mix flow ingested by the inlet and present a uniform flow velocity distribution to the propulsion pump 27.

A single inlet duct 26, designed to mix flow ingested by the inlet and present a uniform flow velocity distribution to the propulsion pump, connects the inlet opening 25 to a single pump 27. As shown, the pump 27 can be positioned on the centerline axis CL in the stern section 7 of the vehicle 1.

As shown in FIG. 3, the power source 15 for driving the pump 27 can include a motor located in the primary pressure hull 9 and can be electrically or mechanically coupled to the pump 27. A flow splitter 29 is required between the pump 27 and the two discharge nozzles 30 since a single pump is used to increase the energy of the fluid in order to drive it out two lateral spaced apart discharge nozzles 30. The flow splitter 29 may be passive or active, controlling the discharge volume flow to each thrust nozzle 30.

As shown in FIG. 3, the two discharge nozzles 30 provide thrust to propel and maneuver the vehicle 1 through the fluid. The discharge nozzles 30 may be vectorable in one or more directions, including the horizontal and vertical directions (represented by X,Y coordinates, respectively) in order to provide vectored thrust, as described below.

Figure 4:
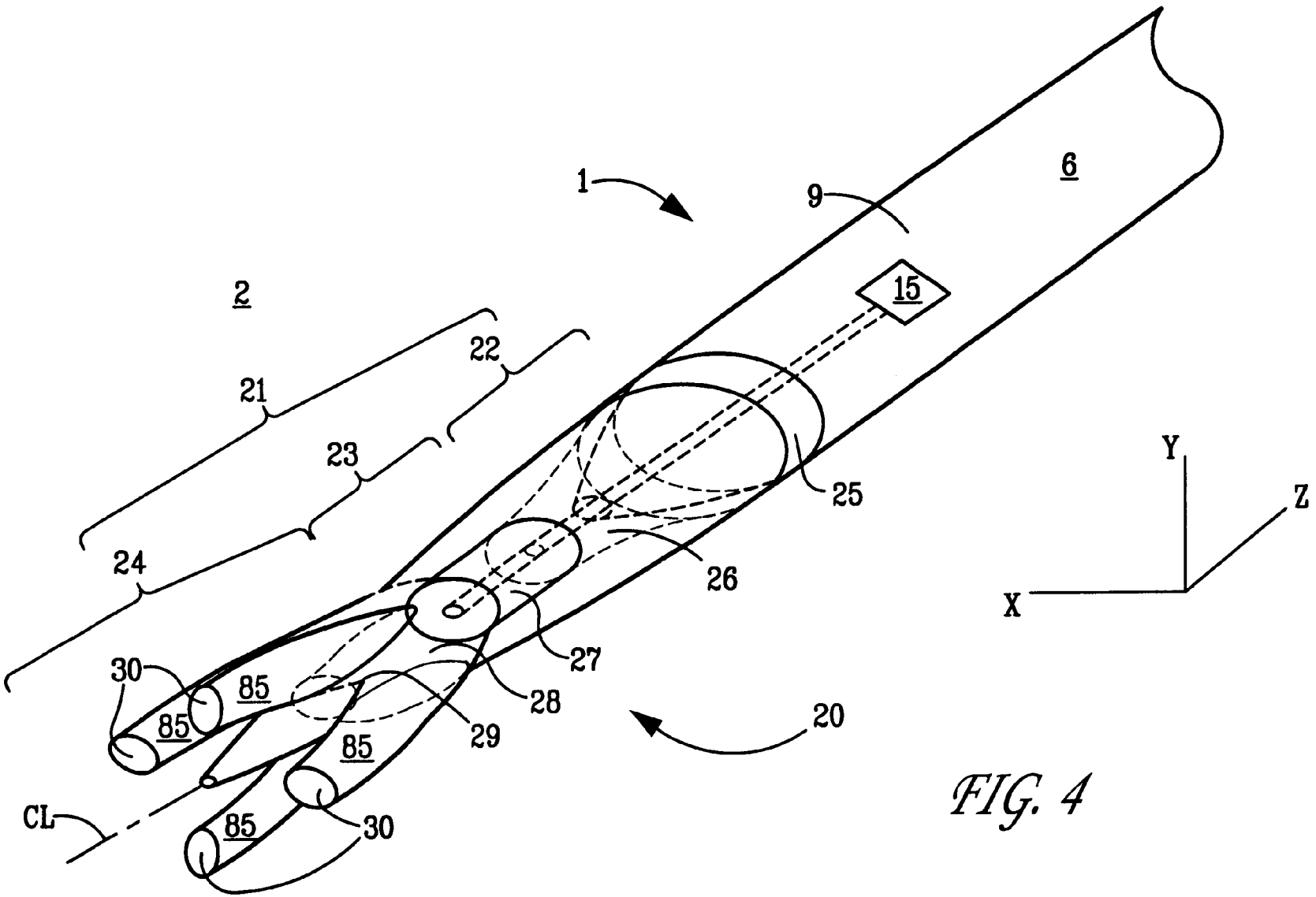
FIG. 4 shows an alternative embodiment of an internal thrust-driven propulsion system having four discharge nozzles located to provide full (e.g., 3 degrees of freedom) maneuvering of the underwater vehicle.

FIG. 4 shows another exemplary embodiment having a full annular inlet 25, an inlet duct 26, a single pump 27, a discharge plenum 28, a flow splitter 29, four discharge ducts 28, and four discharge nozzles 30. As shown in FIG. 4, the full annular inlet 25 circumscribes the entire 360 degrees of the vehicle circumference. Where a full annular type inlet opening is used, connecting members or struts (not shown) can be used to connect the stern section 7 and the mid-ship section 6. As shown, the single, full annular inlet 25 delivers fluid flow through an inlet duct 26 to a single propulsion pump 27 located on the vehicle centerline. The motor 15 for powering the pump 27 is located in the primary pressure hull 9.

In the embodiment illustrated in FIG. 4, the pump 27 drives fluid to four vectorable discharge nozzles 30 arranged axi-symmetrically about the longitudinal centerline axis CL of the vehicle. Two discharge nozzles 30 are positioned in a laterally spaced apart relationship along the horizontal beam parallel to the horizontal axis (X-axis) and on opposite side of the longitudinal centerline axis CL of the vehicle, and two discharge nozzles 30 are positioned in a vertically spaced apart relationship parallel to the vertical axis (Y-axis) of the vehicle 1. This design results in equal maneuvering performance in the horizontal (yaw) plane and the vertical (pitch) planes. While this design achieves high efficiency in straight and level flight, due to the full annular inlet, this design may result in the ingestion of turbulent fluid flow from appendages and structures on the top of the vehicle hull and may also allow a significant distortion of the velocity distribution at the inlet of the propeller or propulsor during a turning maneuver.

The selection of two or more inlets 25 and their locations can alleviate these problems. The use of multiple inlets 25 connected individually to multiple propulsion pumps 27 eliminates the detrimental effects of flow velocity distortions at the pump inlets as each pump 27 can be adjusted to accommodate the current flow velocity condition magnitude at its inlet by adjusting its operating RPM.

Figure 5:
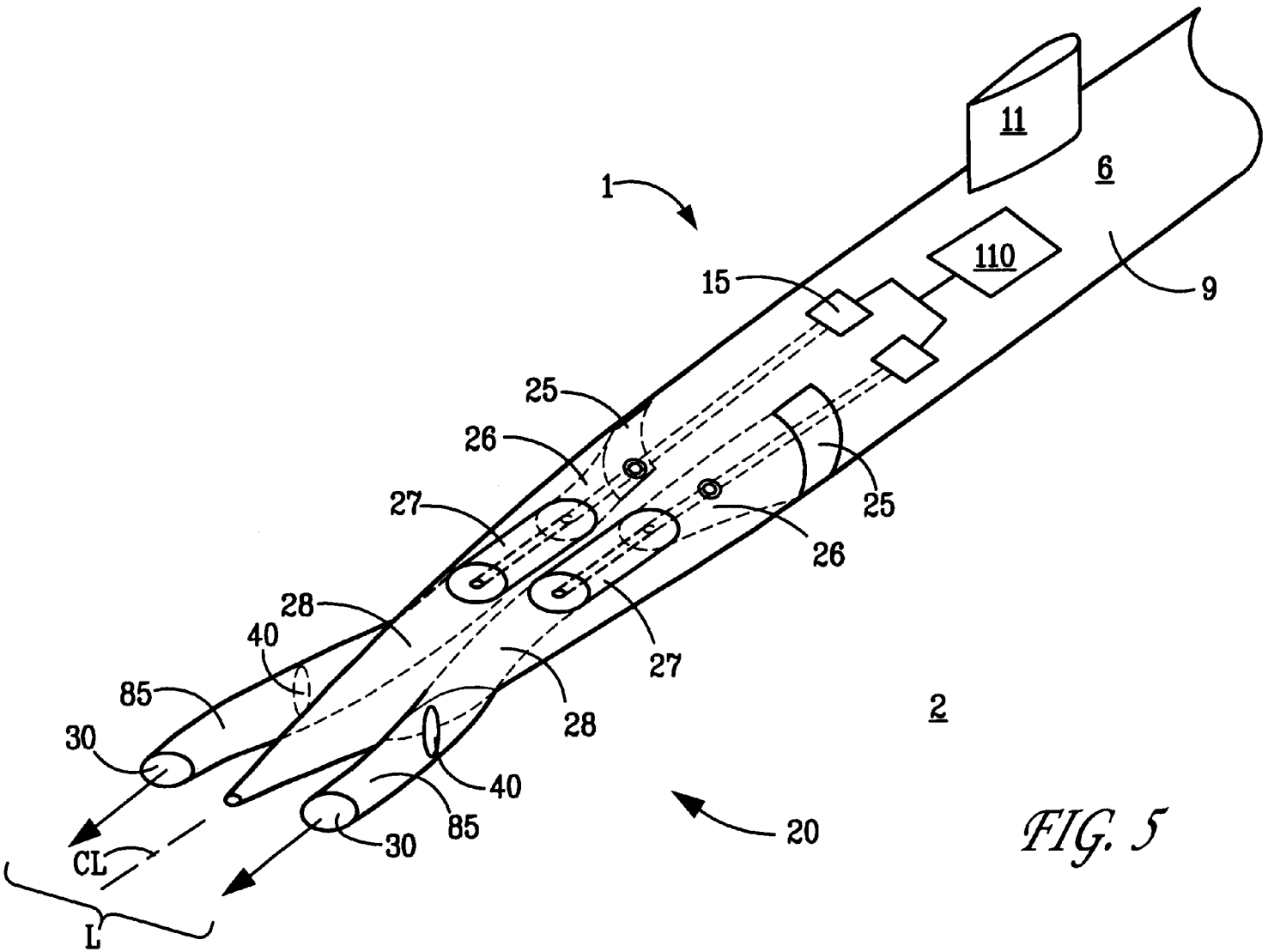
FIG. 5 shows a partial sectional view of another embodiment of an internal thrust-driven propulsion system having multiple pumps.

FIG. 5 shows another exemplary submarine vehicle 1 having a thrust-driven propulsion system 20 including two fluid propulsors 21. Each fluid propulsor includes a partial annular inlet 25 that provide fluid flow through an inlet duct 26 to independent propulsion pumps 27. One inlet and pump are located with the starboard side fluid propulsor 21 and one inlet and pump are located with the port side fluid propulsor 21. The inlets 25 are located to eliminate ingestion of turbulence from appendages and structures located on the top of the submarine vehicle or the ingestion of debris while the vehicle 1 operates near the bottom of a fluid medium. The pump inlet ducts 26 are designed to mix flow ingested by the inlet and present a uniform flow velocity distribution to the respective propulsion pumps 27.

Figure 6:
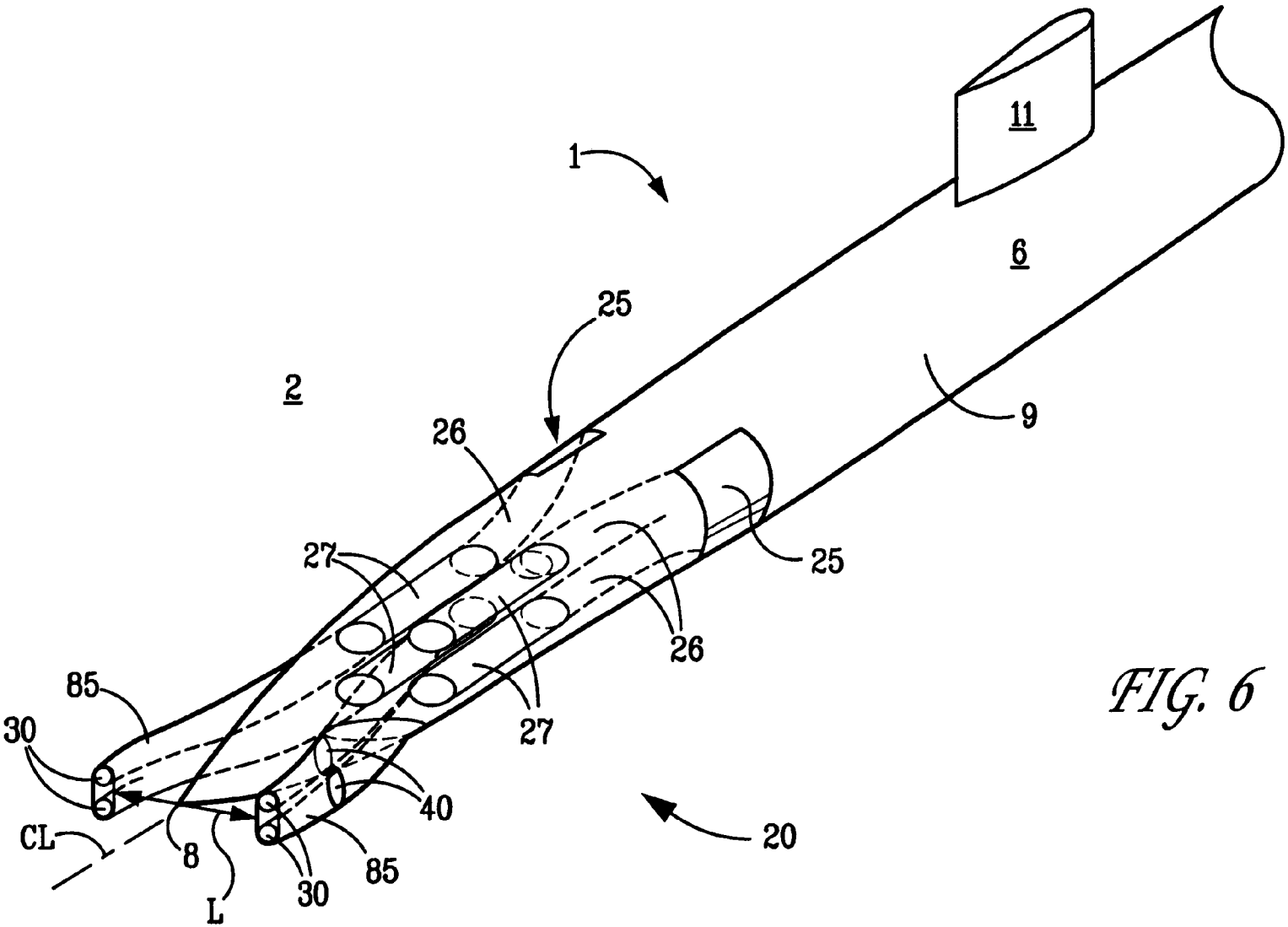
FIG. 6 shows a partial sectional view of another embodiment of an internal thrust-driven propulsion system having a pair of starboard and port stacked discharge nozzles and multiple pumps.

FIG. 6 illustrates another exemplary submarine vehicle 1 having a thrust-driven propulsion system 20 with two partial annular inlets, each providing fluid flow to two independent propulsion pumps. One inlet and two propulsion pumps are located with the starboard side propulsion system and one inlet and two pumps are located with the port side propulsion system.

As shown in FIG. 6, each partial annular inlet opening 25 spans approximately ¼ (e.g., 90°) of the circumference of the hull and one partial annular inlet is located the starboard side and one partial annular inlet is located the port side. Preferably, the two partial inlets 25 are positioned to exclude ingestion of foreign objects from a surface below the vehicle 1 or air from the surface above the vehicle 1. Additionally, if containers or other flow disturbing bodies are mounted on the back of the vehicle the wakes from these bodies will not disturb the flow entering the pumping system. Each inlet opening 25 is connected to a pump 27 through an inlet duct 26. The pump inlet ducts 26 are designed to split the inlet fluid flow into nearly equal rates of flow and then individually mix the ingested fluid flow and present a uniform flow velocity distribution to the respective propulsion pumps. Four independent fluid flow inlets could be used with this system.

Each pump 27 is connected to a discharge nozzle 30 and drives fluid out one or more discharge nozzles 30. Preferably, the ducting 26, 28 is conformal with the hull and provides a smooth path for flow to enter and exit the internal flow ducts. Preferably, in embodiments employing multiple pumps, the pumps 27 and their associated inlet ducting 26 and outlet ducting 28 are positioned longitudinally within the body 3 of the vehicle 1 along opposite sides of the longitudinal centerline CL of the vehicle 1.

Ducting cross connections (not shown) can be provided to cross connect the starboard inlet to the port pump and the port inlet to the starboard pump and to cross connect the starboard pump to the port discharge nozzle and the port pump to the starboard discharge nozzle. Preferably, the cross-connections allow one inlet to supply a fluid flow to either or both pumps and allow each pump to drive fluid out of either or both discharge nozzles. Embodiments having multiple components provide redundancy and improve the survivability of the vehicle.

As shown in FIG. 6, the four discharge nozzles 30 are positioned as two pairs of stacked discharge nozzles in a laterally spaced-apart relationship. Preferably each separate discharge stream is capable of one or more of differential thrust and vectorable thrust. For example, preferably, each pump 27 is independently operatable to provide individual differential thrust control and each discharge nozzle 30 is preferably independently operatable to provide individual vectored thrust control.

Embodiments having two or more pumps, such as the embodiments shown in FIGS. 5 and 6, allow for differential thrust of the flow exiting the vehicle 1. Where only one pump is used, flow diverter plates may be selectively moved into and out of the outlet ducting to the laterally spaced apart discharge nozzles 30 to achieve differential thrust.

Figure 7:
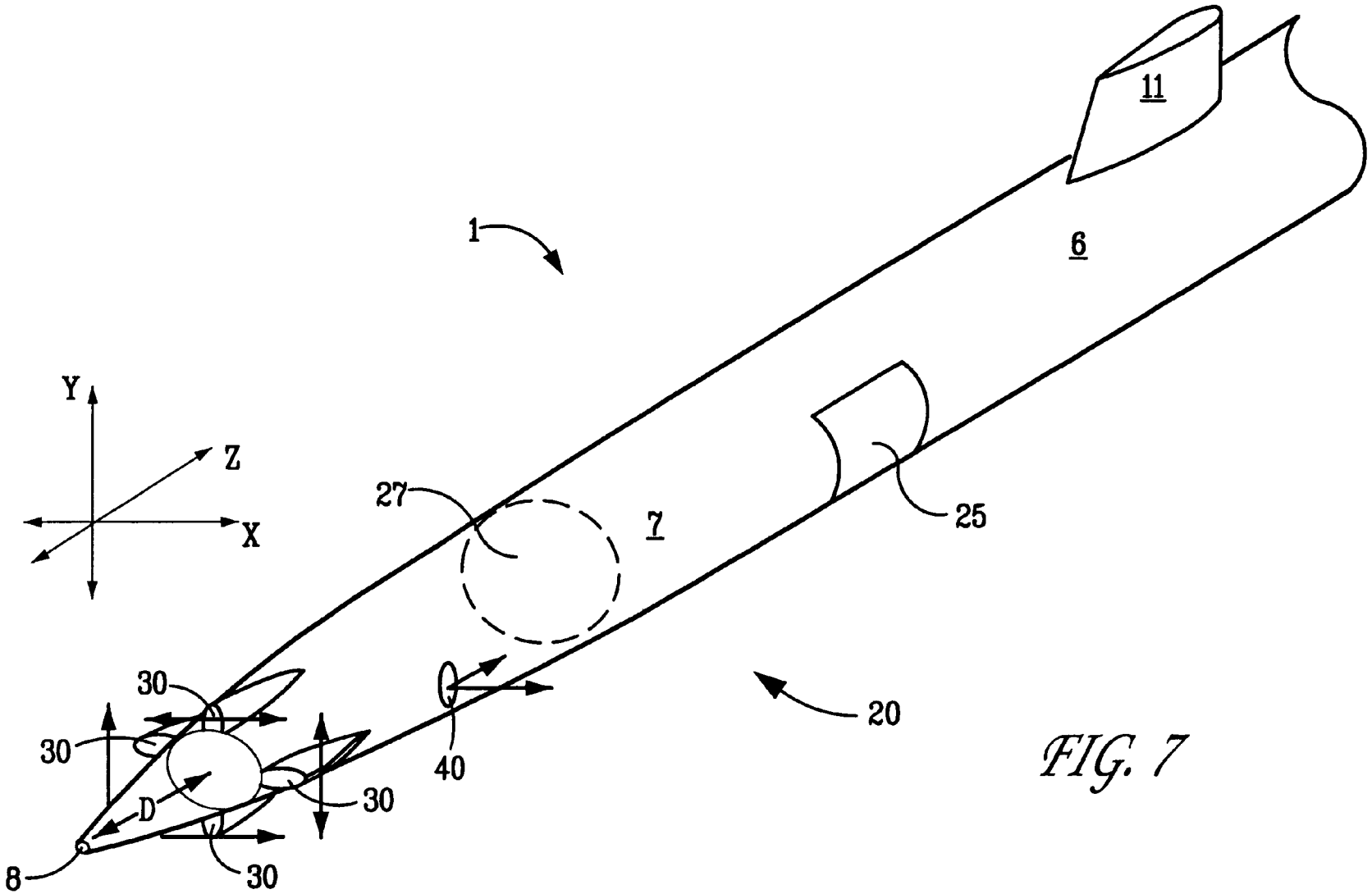
FIG. 7 shows a partial sectional view of another embodiment of an internal thrust-driven propulsion system wherein the discharge nozzles are located some distance forward of the aft distal end of the stem.

FIG. 7 shows an embodiment wherein the discharge nozzles 30 are not located at the aft distal end of the stern 8.

As shown in FIG. 7, the discharge nozzles 30 can be located in the stern section 7 at some distance D forward of the distal end of the stern 8. This embodiment includes an axisymmetric arrangement of the four discharge nozzles 30. Two nozzles are positioned in a laterally spaced apart relationship parallel to the horizontal axis and two nozzles are positioned in a vertically spaced apart relationship parallel to the vertical axis. The laterally spaced apart nozzles can provide differential and vertical thrust vectoring, and the vertically spaced apart nozzles can provide differential and horizontal thrust vectoring. Preferably, all four nozzles 30 can provide vertical and/or horizontal vectoring.

Vectored Thrust

Preferably, the discharge nozzles 30 are movable or vectorable and are thus capable of producing vectored thrust in one or more dimensions. More preferably, the discharge nozzles 30 are vectorable in at least two dimensions, including a horizontal direction (X-axis) for producing thrust in the horizontal or yaw plane (e.g., horizontal turning to port and starboard) and a vertical direction (Y-axis) for producing a vertical thrust in the vertical or pitch plane (e.g., vertical ascending and diving) resulting in multiple degrees of freedom of thrust vectoring.

The ability to change or vector the direction of the fluid flow is used to control the direction of thrust, which facilitates maneuvering of the submarine vehicle 1. Rotation of a discharge nozzle 30 in the yaw plane causes the submarine vehicle 1 to turn in the horizontal plane. Rotation of a discharge nozzle 30 in the pitch plane causes the submarine vehicle 1 to rise or dive, changing the depth of the vehicle 1. The use of differential pitch vectoring is used to control the roll rate or list angle of the vehicle 1.

FIGS. 3, 8A, 8B, 8C, and 13 show an exemplary thrust-driven propulsion system 20 having vectored thrust. As shown in the Figures, full maneuvering can be achieved by moving/rotating the discharge nozzles 30 in the horizontal direction or yaw plane (X-axis) to cause the exiting flow of fluid to be at an angle $\alpha$ from the horizontal axis (X-axis) and in the vertical direction or pitch plane (Y-axis) to cause the exiting flow of fluid to be at an angle $\beta$ from the vertical axis (Y-axis), resulting in thrust at an angle $\theta$ thereby providing vectored thrust in at least three degrees of freedom so that the discharge pattern of the discharge nozzles 30 covers an array of yaw and pitch.

The discharge nozzles 30 can be vectored together, such that they discharge in the same relative direction, or alternatively, each discharge nozzle 30 can be vectored independently of the other nozzle(s) so that each discharge nozzle 30 discharges in a different relative direction. This allows the vectored thrust propulsion system 20 to more effective control the yaw, pitch, and roll of the vehicle 1.

Thrust Vectoring Actuator Device

A thrust vectoring actuator device 90 is provided for moving the discharge nozzles 30 at the aft end of the vehicle 1. Preferably, the thrust vectoring actuator device 90 provides for one or more of horizontal movement (X-axis) and vertical movement (Y-axis) of the discharge nozzles 30 to change the position of the discharge nozzles 30 in the yaw plane and the pitch plane and thus the direction of the high-energy flow exiting the vehicle 1. More preferably, the thrust vectoring actuator device 90 provides for both horizontal and vertical movement of the discharge nozzles 30 resulting in vectored thrust in multiple degrees of freedom (e.g., allowing independent selection of both horizontal and vertical components within the mechanical limitations of a particular application).

In one embodiment, a controller (not shown) controls the vectoring such that each discharge nozzle 30 is vectorable independently for the other discharge nozzles 30. In an alternate embodiment, the controller controls the vectoring so that the discharge nozzles 30 cooperate to provide the desired movement of the vehicle 1.

Figure 8A:
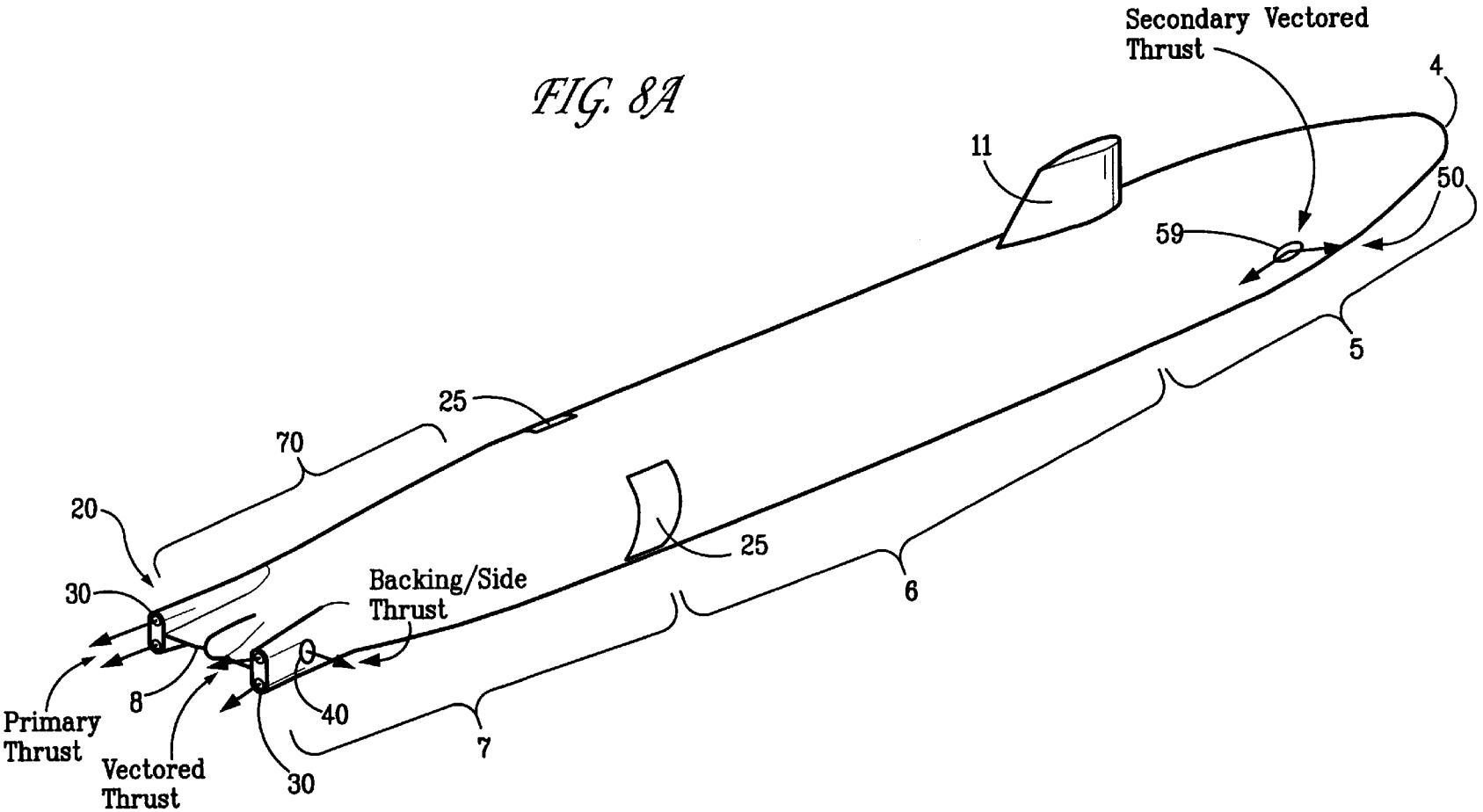
FIG. 8A shows an exemplary vehicle showing primary thrust, backing thrust, and secondary bow thrust, and also vectored thrust.
Figure 8B:
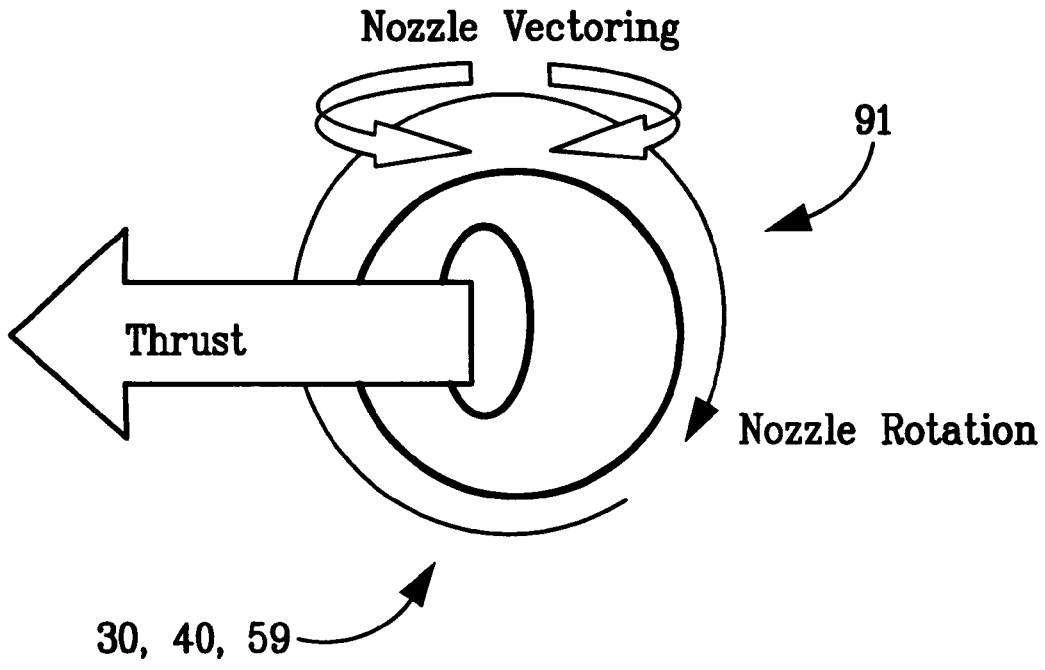
FIG. 8B shows an exemplary view of nozzle movement to achieve thrust vectoring.
Figure 8C:
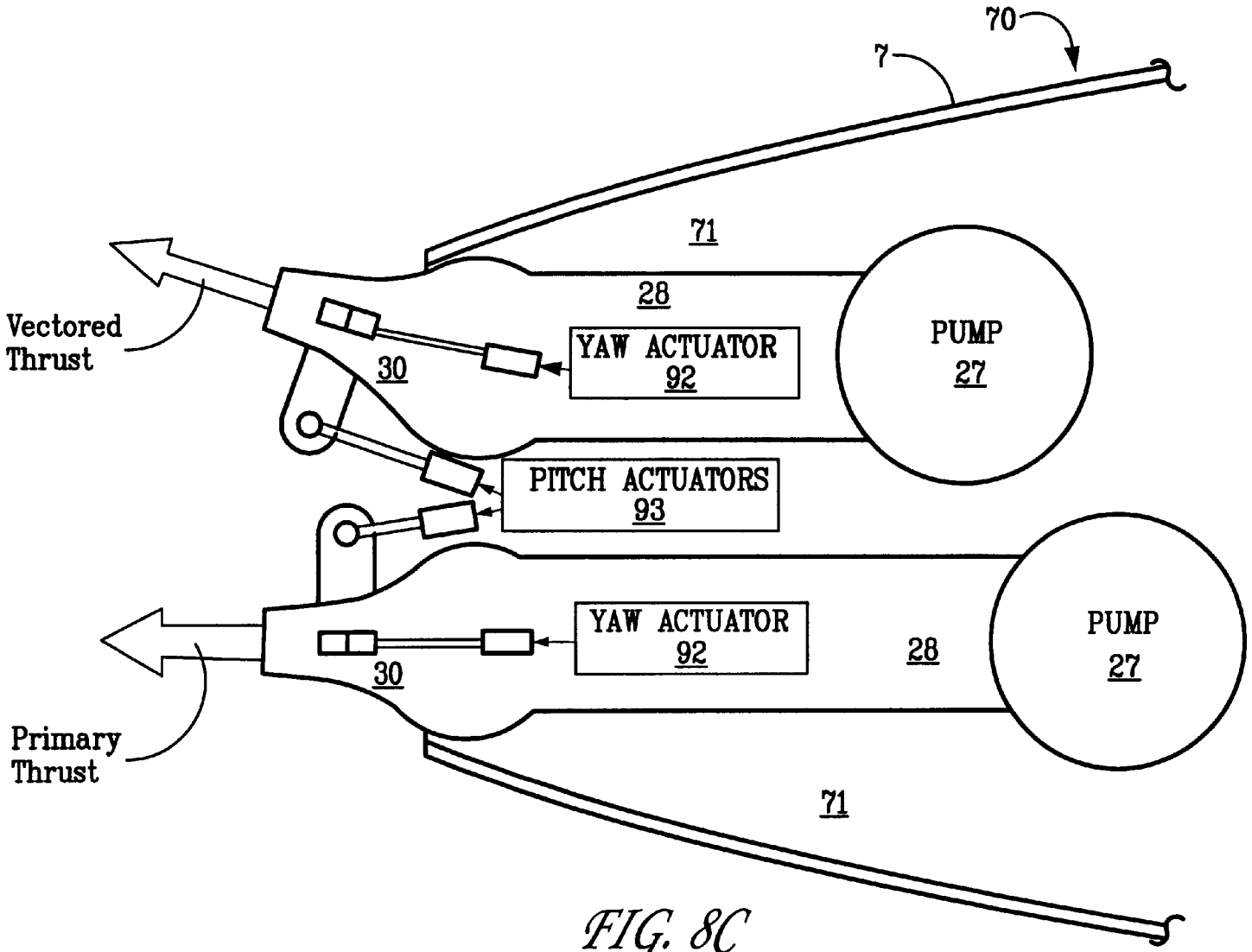
FIG. 8C shows an inboard side view of exemplary primary propulsion nozzles including yaw and pitch actuators of the vectored thrust propulsion system.

For example, as shown in FIGS. 8B and 8C, the discharge nozzles 30 can be mounted on spherical bearings or gimbals 91, allowing vectored thrust to be generated. This movement causes the discharging fluid flow to be at an angle $\theta$ from the longitudinal centerline axis CL of the vehicle 1. The movement of the discharge nozzles 30 in either or both of the horizontal and vertical directions results in the independent selection of possible discharge angles for the fluid flow exiting the nozzles 30. Other means of altering the discharge angles of the thrust nozzles, such as, for example, flexible coupling, movable vanes in the discharge nozzles, a variable geometry or articulated nozzle, and the like can also be used.

FIG. 8C shows one exemplary embodiment of how vectoring of the discharge stream exiting the discharge nozzles 30 can be achieved. FIG. 8C shows an inboard view of the starboard set of linear discharge nozzles 30 of the embodiment shown in FIG. 8A.

As shown in FIG. 8C, the pumps 27 drive the fluid through the outlet ducts 28 to individual discharge nozzles 30. One or more yaw actuators 92 can be provided to move the discharge nozzle 30 side to side in order to produce horizontal thrust vectoring and one or more pitch actuators 93 can be provided to move the discharge nozzle 30 up and down in order to produce vertical thrust vectoring. Preferably, two yaw actuators 92 and two pitch actuators 93 are provided, wherein the two yaw actuators 92 are positioned approximately 180° apart on each side of each discharge nozzle 30 and the two pitch actuators 93 are positioned approximately 180° apart on each the top and bottom of each discharge nozzle 30.

In combination, the yaw and pitch actuators 92, 93 can provide positive control of the movement of each discharge nozzle 30 over an array of fluid discharge patterns. The discharge nozzles 30 can also include other suitable designs, such as for example, a rotating type nozzle, that provide at least two directional vectoring of the fluid flow being discharged from each discharge nozzle.

The ability to generate vectored thrust, by changing the discharge angle of the fluid flow exiting the discharge nozzles, and/or differential thrust, by controlling the volume of fluid flow supplied to each discharge nozzle, assists in the maneuverability and control of the vehicle in yaw, pitch, and roll.

Backing Capability

A submarine vehicle 1 typically requires the capability to move in a reversed or backing direction as well as in the conventional or forward direction. A submarine vehicle 1 also typically requires the capability to reduce its forward speed quickly. For example, a conventional submarine vehicle 1 with a propeller or propulsor can achieve some degree of reversed thrust by reversing the direction of rotation of the propeller or propulsor. The degree of reversed thrust generated by a propeller or propulsor is always less than the degree of forward thrust that can be generated. In addition, in propulsion systems using mixed or radial flow pumps, the pumps cannot operate in a reversed flow direction. Furthermore, axial flow pumps that operate at low ratio of RPM to fluid flow speed are generally ineffective in generating backing thrust in the reversed pumping direction.

One means of producing reversed or backing thrust that is independent of propeller, propulsor, or pump performance, is to vector the ingested fluid flow into the forward direction, rather than the conventional or backward direction.

Additionally, the ability to vector this thrust in athwartship and vertical directions provides an improved capability to maneuver the submarine vehicle 1 in the yaw or turning, and pitch or depth planes.

As shown in FIGS. 2–8A, the underwater vehicle 1 preferably further includes the capability to produce backing and/or athwartship thrust to assist in maneuvering, to assist in stopping the vehicle, and to propel the vehicle in the reverse direction. Backing thrust can be achieved using flow diverter devices or backing doors 42 that divert the flow exiting the propulsion pump 27 from the discharge nozzles 30 to at least two backing nozzles 40.

Backing Doors

Backing thrust can be produced by actuating flow diverter devices or backing doors 42, connected to the propulsion pump discharge ducts 28. By proper design, these doors 42 divert fluid flow from the primary thrust nozzles 30 to backing nozzles 40.

Figure 9:
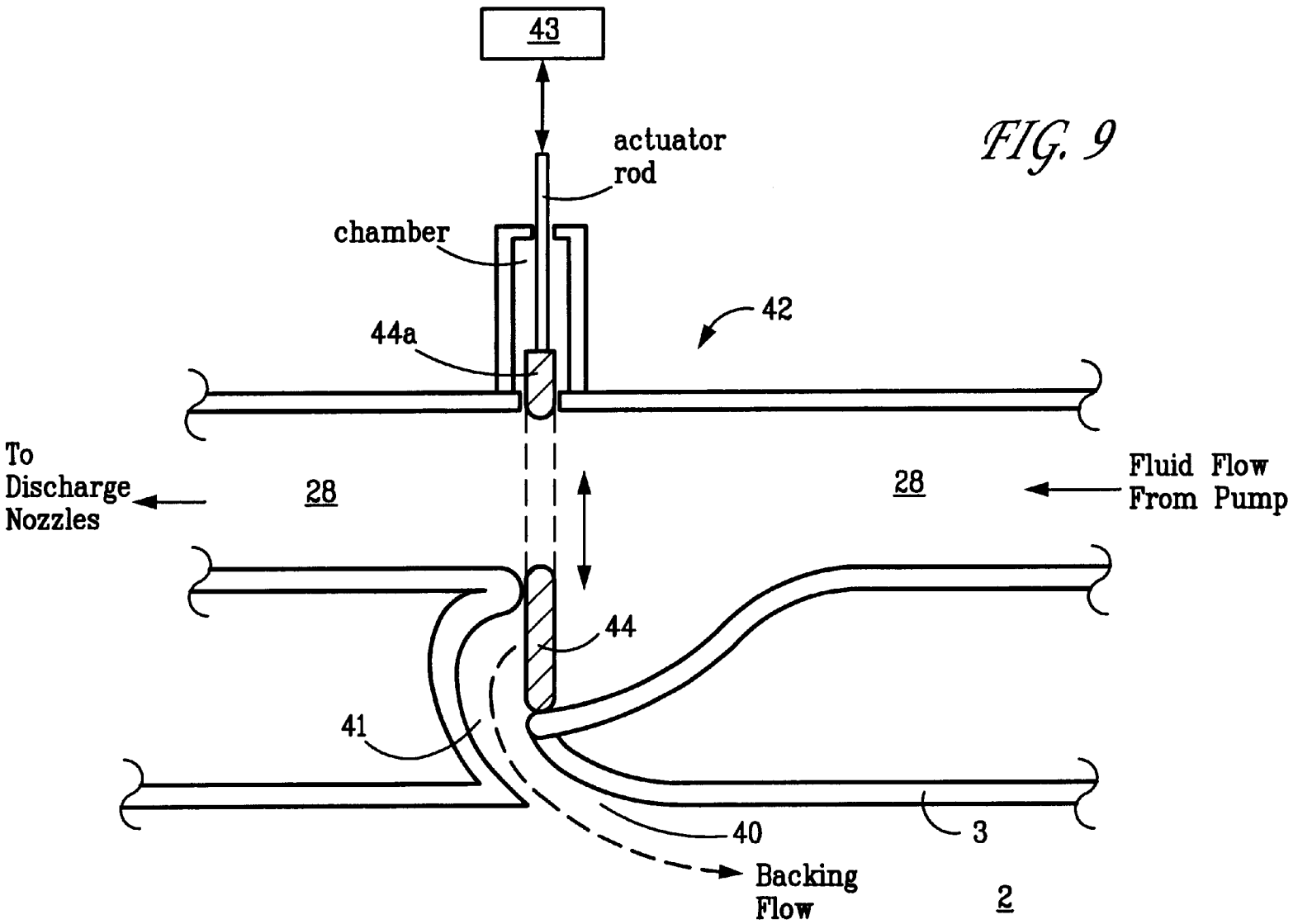
FIG. 9 shows an exemplary diverting device for generating a backing or reverse thrust by directing the flow from the linear discharge nozzles to the backing nozzles for producing backing and/or athwartship thrust.
Figure 10:
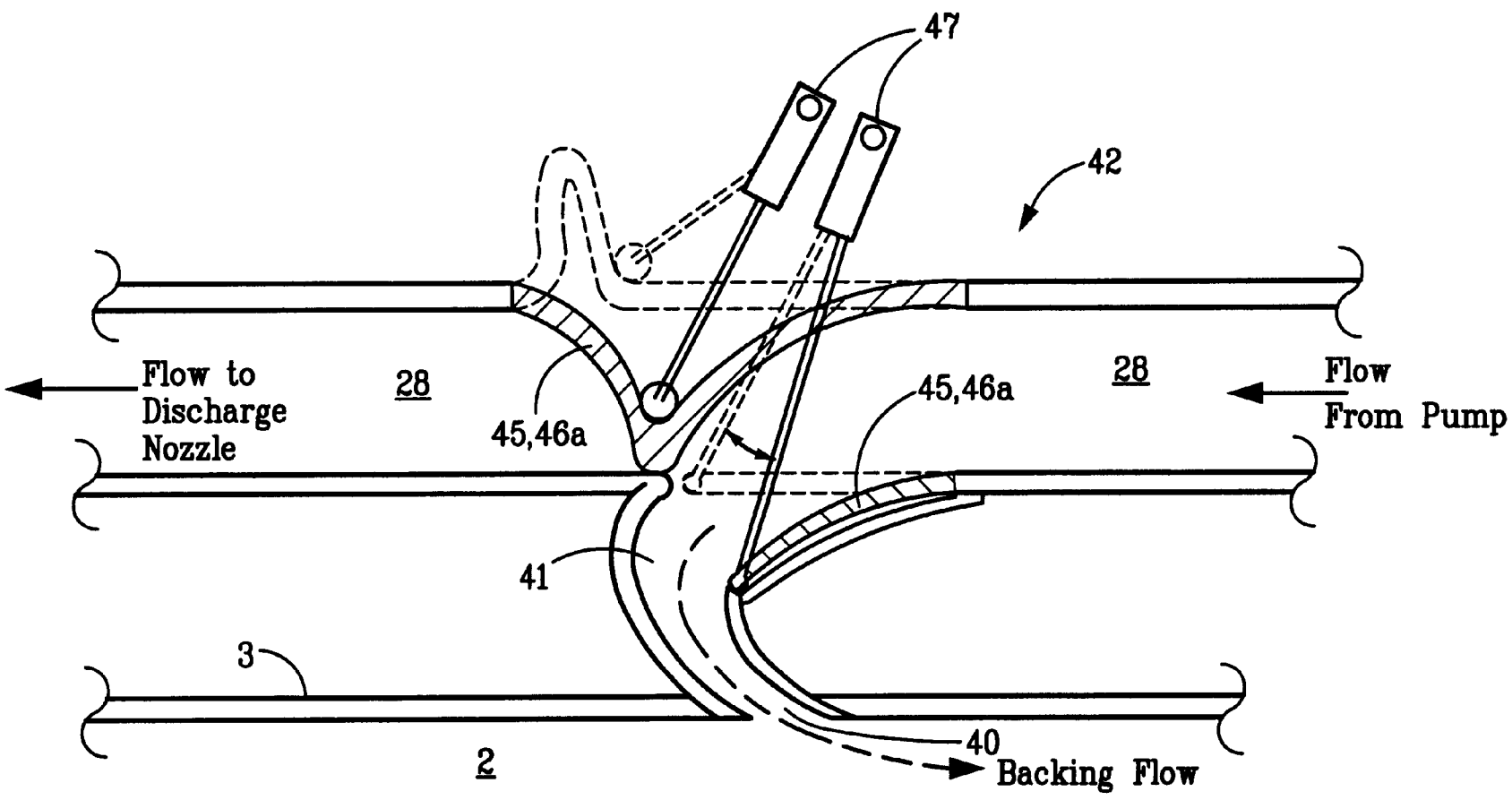
FIG. 10 shows another exemplary diverting device for generating a backing and/or athwartship thrust.
Figure 11:
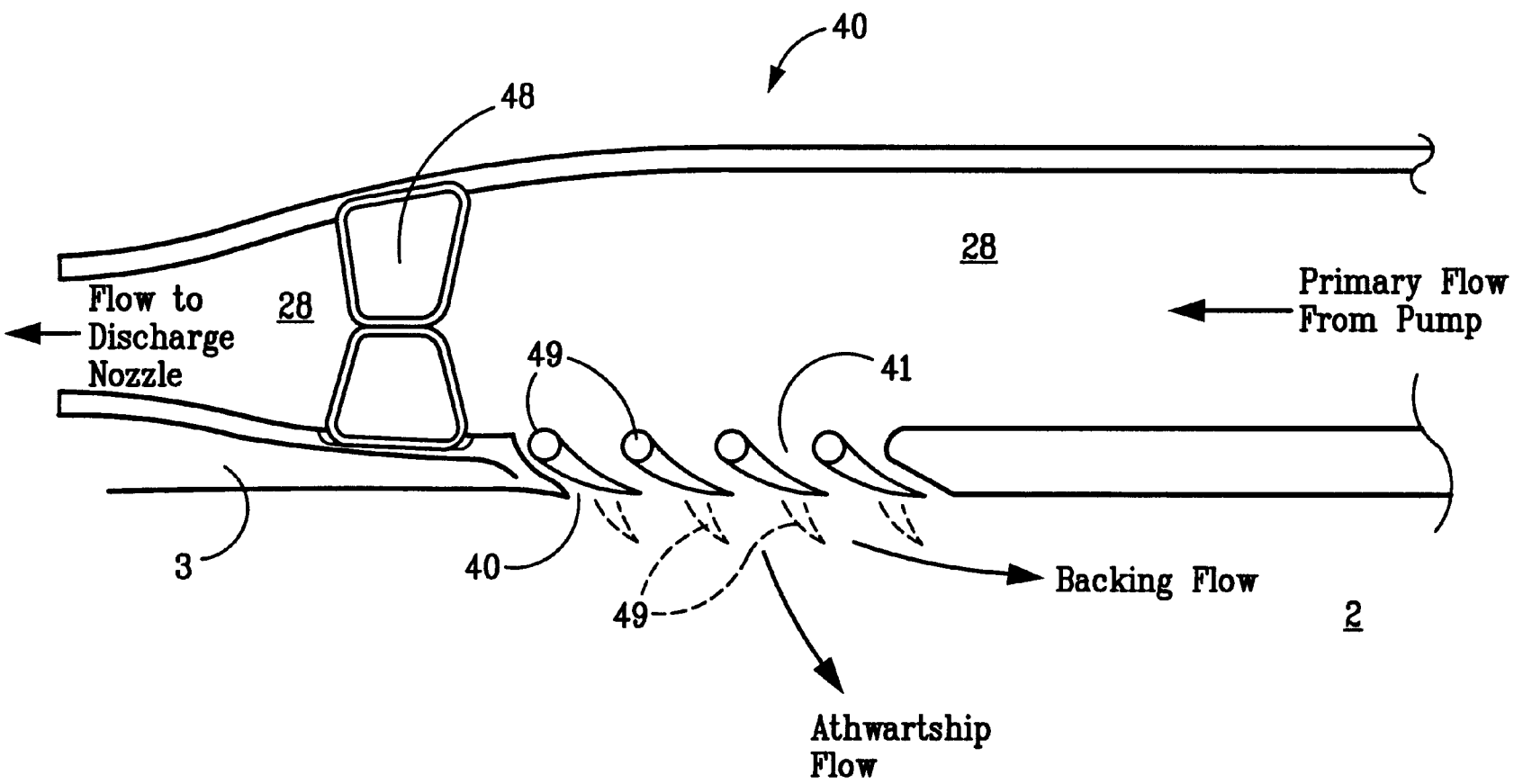
FIG. 11 shows another exemplary diverting device for generating a backing or reverse thrust.

FIGS. 9–11 show several exemplary embodiments of how backing thrust can be achieved. As shown in FIGS. 9–11, a flow diverter device or backing door 42 selectively diverts the flow of fluid exiting the pumps 27 from one of the discharge nozzles 30 to one of the backing nozzles 40. An actuator 43 is coupled to the backing door 42 to control the movement of the backing door 42.

FIG. 9 shows a sliding gate type backing door 42. As shown in FIG. 9, in a first or lower position, the sliding gate is positioned to allow the primary flow of fluid exiting the pump 27 to flow to the discharge nozzles 30 to produce a forward thrust on the vehicle 1. A gate 44 blocks and closes off a backing duct 41 leading to the backing nozzle 40. When backing thrust is desired, an actuator 43 moves (e.g., lifts) the sliding gate to a second or upper position wherein the fluid flow to the discharge nozzles 30 is closed off by the gate 44 and the fluid flow is diverted through the backing duct 41 to the backing nozzle 40 that produces a reversing or backing thrust on the vehicle 1. The backing nozzles 40 direct the exiting fluid flow in a forward direction generally toward the bow 4 of the vehicle 1 to produce the backing thrust.

A sealing element 44*a* can be provided to prevent the leakage of fluid around the sliding gate 44 and actuator 43 elements. As shown, the sealing element 44*a* seals an opening in the outlet duct where the sliding gate extends therethrough when the sliding gate 44 is in the first or lower position. When the sliding gate 44 has been actuated and backing thrust is being applied, the sealing element 44*a* seals the top end of a chamber to prevent leakage of fluid around the actuator rod.

FIG. 10 shows another exemplary embodiment for producing a backing thrust including a flexible membrane type backing door 42. As shown in FIG. 10, the flexible membranes 45 is selectively movable between a first position (shown in dashed lines) wherein the fluid flow exiting the pump 27 is directed to the discharge nozzles 30 to produce a forward thrust of the vehicle 1 and a second position (shown in solid lines) wherein the fluid flow is directed to the backing nozzles 40 to produce a backing thrust.

As shown in FIG. 10, the flexible membrane 45 includes two flexible diverter elements, a first flexible diverter element 46*a* and a second flexible diverter element 46*b*. The first flexible diverter element 46*a* is positioned in the main outlet duct 28 and selectively opens and closes the main outlet duct 28 to the discharge nozzles 30. The second flexible diverter element 46*b* is positioned in the backing duct 41 and selectively opens and closes the backing duct 41 to the backing nozzles 40. The first and second flexible elements 46*a*, 46*b* cooperate to control the direction of the fluid flow. For example, the first and second flexible elements 46*a*, 46*b* cooperate such that when the first flexible element 46*a* is in the open position the second flexible element 46*b* is in the closed position, and when the first flexible element 46*a* is in the closed position the second flexible element 46*b* is in the open position. One or more actuators 47 are provided to control the operation of the flexible membrane type backing door 42.

FIG. 11 shows another suitable arrangement for achieving backing thrust. As shown in FIG. 11, the backing door includes a cuff or iris valve 48 that acts to selectively divert the flow of fluid exiting the pump 27 to one of the discharge nozzles 30 and the backing nozzles 40. The cuff or iris valve 48 includes an inflatable cuff that is actuated by a gas or fluid source to selectively deflate and inflate the inflatable cuff thereby selectively diverting the flow of fluid between the discharge nozzles 30 and the backing nozzles 40, respectively.

As shown in FIG. 11, a plurality of louvers 49 are located proximate the hull 7 of the vehicle 1 between the outlet duct 41 and the operating environment 2. The louvers 49 are selectively movable between an open and close position. When the cuff 48 is inactive (deflated), the louvers 49 are in the closed position and the fluid flow is directed to the discharge nozzles 30 and a forward thrust is produced. When the cuff 48 is activated (inflated), the louvers 49 move from the closed position to the open position and the fluid flow is diverted to the backing nozzles 40 and a backing thrust is produced. Preferably, the louvers 49 are movable and thus capable of producing vectored thrust generally in the reverse (shown in FIG. 11 in solid lines) and/or generally in the athwartship direction (shown in FIG. 11 in dashed lines).

Backing Nozzles

The backing nozzles 40 are located in a laterally spaced apart relationship with at least one backing nozzle located proximate the port side and at least one backing nozzle located proximate the starboard side of the vehicle 1. Each backing nozzle 30 receives fluid from the fluid pump 27 from a backing duct 41 that branches off a respective outlet duct 28.

In the normal (e.g., non-vectoring) position, the backing nozzles 40 discharge flow generally in the forward axial direction in a direction substantially parallel to the longitudinal center axis of the vehicle 1 producing reverse thrust to stop the forward motion of the vehicle 1 or to propel the vehicle in the reverse or backward direction. Preferably, a backing door 42 is positioned to cover each backing nozzle 30 when the backing nozzles 40 are not in use.

FIGS. 2, 3, 5, 6, and 8A show exemplary backing nozzles 40. As shown, the backing nozzles 40 are preferably positioned to receive a flow of fluid exiting the pumps 27 that has been diverted from the discharge nozzles 30. Flow may be diverted to one or more backing nozzles 40 during maneuvering operations, in order to reverse the direction of the vehicle 1, or to stop the movement of the vehicle 1 through the fluid.

Preferably, the backing nozzles 40 can be vectored, in a manner similar to the discharge nozzles, so as to produce thrust that has a varying angle with respect to the longitudinal centerline axis of the submarine vehicle. Preferably, the angle at which the backing nozzles are discharging the fluid flow can vary in a horizontal plane between a backing, athwartship, and forward direction to provide to one or more of a backing and forward thrust (Z-axis) and an athwartship thrust (X-axis), respectively. In addition, the backing nozzles are preferably vectorable in the vertical plane to provide a diving or surfacing thrust.

Secondary Thrust Propulsion System

As an adjunct to the described distributed primary thrust-driven propulsion system 20, secondary thrust generating systems 50, i.e. thrusters, can be added to the underwater vehicle 1 in appropriate locations, such as, for example, the bow section 5. The secondary thrust generating systems 50 include one or more fluid propulsors 51, each having an inlet section 52, a fluid pumping section 53, and an outlet section 54. In a preferred arrangement, secondary thrusters are located in the bow section 5 on the horizontal centerline, starboard and port sides.

Preferably, a vectoring mechanism allows thrust to be vectored in directions parallel to the hull in a 360 degree azimuth angle, and a second degree of freedom allows thrust to be vectored generally in a direction perpendicular to the hull. The use of two or more thrusters to generate secondary thrust further facilitates maneuvering of the vehicle in at least multiple degrees of freedom, including vehicle pitch, yaw, and roll motions, and ahead or backing ship speed changes.

Figure 12:
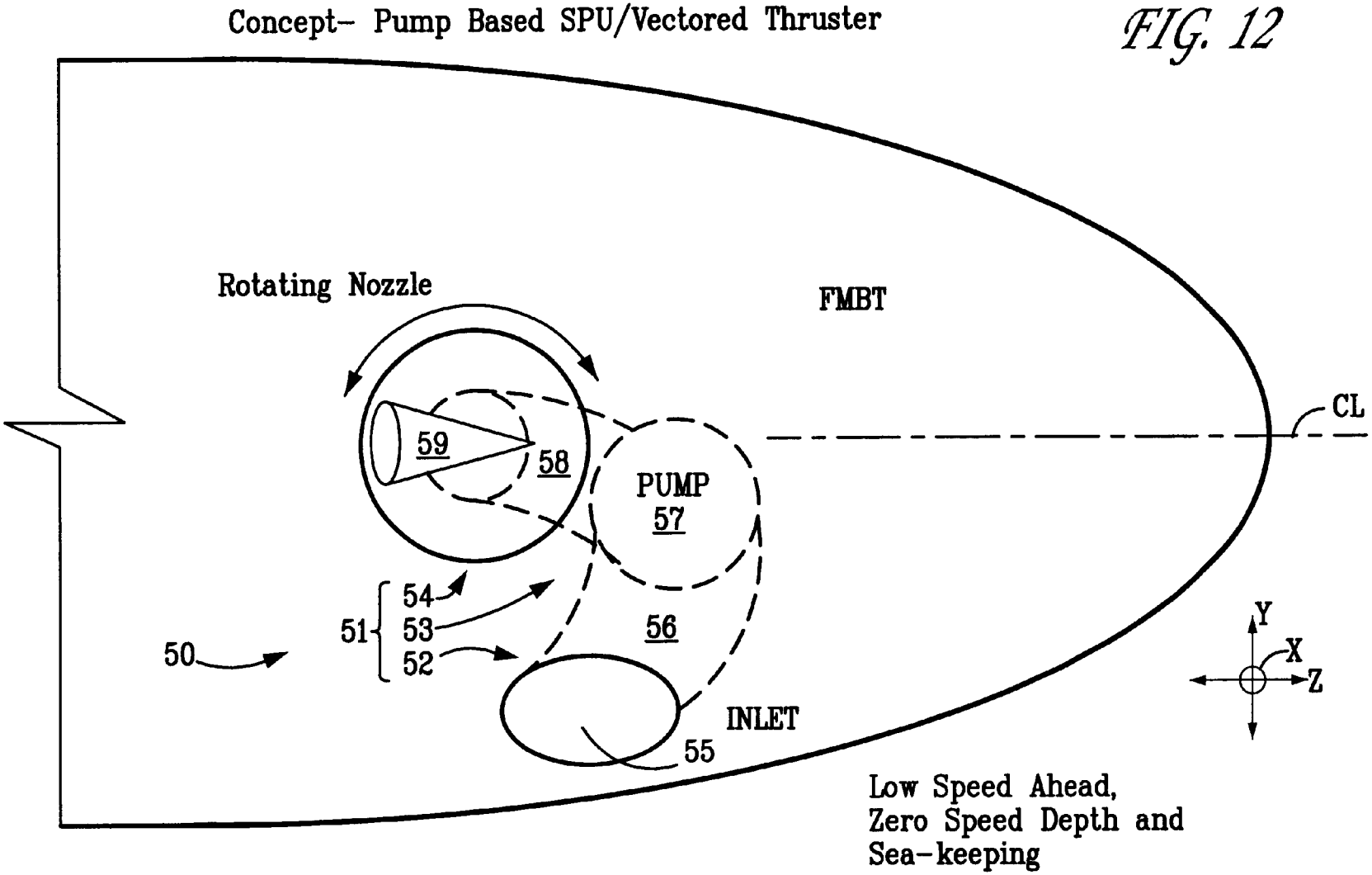
FIG. 12 shows an exemplary secondary vectored thrust propulsion system for providing vectored thrust at the forward section of the vehicle.

FIGS. 8A and 12 show the bow section 5 of an exemplary underwater vehicle 1 having a bow vectored thrust propulsion system 50. As shown in FIG. 12, the bow vectored thrust propulsion system 50 includes at least one inlet opening 55, inlet ducting 56, at least one pump 57, outlet ducting 58, and at least two discharge nozzles 59 (only the starboard discharge nozzle 59 is shown) located in a laterally spaced apart relationship on opposite sides of the longitudinal centerline axis CL. The operation of the bow vectored thrust system 50 would be similar to the operation of the thrust-driven propulsion system 20 discussed previously and is preferably capable of vectored thrust in a manner similar to the discharge nozzles 30.

Preferably, the at least two discharge nozzles 59 include one discharge nozzle located on the port side of the vehicle and one discharge nozzle located on the starboard side of the vehicle 1. Preferably, the discharge nozzles are capable of producing vectored thrust in at least two directions, including one or more of: the fore and aft direction (Z-axis); an athwartships (e.g., port or starboard) direction (X-axis); and the vertical direction (Y-axis).

In other embodiments (not shown), the secondary thrust propulsion system 50 can include a topside discharge nozzle and/or a bottom side discharge nozzle. The top side discharge nozzle would discharge normally in the vertical direction upward and be capable of being vectorable in the fore and aft direction (Z-axis) and the horizontal direction (X-axis). The bottom side discharge nozzle would discharge normally in the vertical direction downward and would be vectorable in the fore and aft direction (Z-axis) and the horizontal direction (X-axis).

Secondary vectored thrust propulsion systems 50, in conjunction with the main vectored thrust propulsion system 20, provide for full maneuverability of the vehicle 1 and also facilitate turning of the vehicle 1 at slow speeds or when the vehicle 1 is stopped. For example, the vehicle 1 can turn on its vertical centerline axis without moving forward or aft. The bow discharge nozzle 50 further facilitate the full maneuverability of the vehicle 1 including low speed ahead and zero speed depth and sea-keeping. This allows the vehicle 1 to operate in shallow and close waterways.

Wedge Shaped Stern Configuration

The stern section of an underwater vehicle, such as a submarine, is preferably streamlined for smooth external flow over the vehicle and typically houses equipment within its volume, including the aft main ballast tank. The underwater vehicle 1 can also include an improved stern configuration that is streamlined for providing a smooth external flow over the vehicle's hull 3 and also increases the volume of the vehicle 1 at the stern 8. The space defining this increased volume provides for the storage of ship systems and ship stores, including machinery, equipment, ballast, weapons, sensors, and the like. FIGS. 13–19 show several exemplary embodiments of a wedge shaped stern configuration for an underwater or submersible vehicle 1.

Wedge Shaped Fairing

As shown in FIGS. 13–19, the stern configuration of an underwater vehicle 1 can include a wedge-shaped fairing 70 defining an internal space 71 having an increased volume as compared to conventional underwater vehicles having a conical tapered stern configuration. The space 71 defining the increased volume starts proximate the aft end of the cylindrical mid-section 6 and extends to the aft distal end of the stern 8. Different from conventional practice the external shape of the wedge shaped fairing fairs smoothly from the cylindrical shape of the mid-ship section 6 to an aft horizontal edge 75 while maintaining a substantially constant width W. Preferably, the width W is equal to the beam of the center section 6 of the vehicle 1.

The tapered wedge-shaped fairing 70 includes several advantages over the tapered cylindrical stern section of conventional underwater vehicles including providing an increased volume defined by the space 71 formed at the stern section that may be used for wet or dry storage. The tapered wedge-shaped fairing 70 also provides a stable platform that can be used to house portions of the thrust-driven propulsion system 20, such as the propulsion pumps 27, outlet ducts 28, and discharge nozzles 30. The wedge-shaped fairing 70, having a preferred width equal to the beam of the vehicle, also helps ensure a sufficient distance between the port and starboard discharge nozzles 30 to achieve proper and efficient maneuvering using differential/vectored thrust. A wedge shaped stern has greater volume than a conventional conical stern shape by approximately 60 percent. This additional volume can be used to house additional ship systems and stores.

A wedge shape is considered to have an added benefit of providing improved ship stability in the pitch plane and allow the flow to converge naturally at the stern 8, in a manner similar to an aircraft wing. This eliminates flow separations and added vehicle drag. The wedge shaped fairing 70 emanates as a smooth transition surface from the vehicle central section 6 and is streamlined to the aft most portion of the stern section 7.

As illustrated in FIGS. 13–19, the wedge-shaped fairing 70 includes an upper tapered surface 73, a lower tapered surface 74, a horizontal edge 75 at the stern 8, and two sidewalls 76. The upper tapered surface 73 and the lower tapered surface 74 each have a substantially constant width as they taper aft from the mid-ship section 6 to the horizontal edge 75.

Port and starboard sidewalls 76 are disposed between and connect the upper tapered surface 73 and the lower tapered surface 74 and also connected at a forward end 77 of the wedge-shaped fairing 70 to the mid-ship section 6. Preferably, the surfaces joining the upper surface 73 and the lower surface 74 to the mid-ship section 6 and with the sidewalls 76 include a contoured surface having a curved (e.g., smooth) radius that ensures a smooth flow of fluid over the surface of the vehicle body 3.

The upper tapered surface 73 and the lower tapered surface 74 can also be formed having faired discharge ducts 85 shown as raised surfaces formed along the port and starboard sides of the tapered surfaces for accommodating the outlet ducting 28 and discharge nozzles 30. The raised surfaces form convex surfaces extending outward from the wedge shaped fairing 70.

The internal space 71 within the wedge-shaped fairing 70 is defined by the upper tapered surface 73, lower tapered surface 74, the two sidewalls 76, and an aft pressure bulkhead 10 at the forward end 77 of the wedge-shaped fairing 70.

As shown, the upper tapered surface 73 and the lower tapered surface 74 have substantially the same length and substantially the same taper angle. Preferably, the width of the wedge shaped fairing 70 is generally constant on the tapered portions. Preferably, the width of the wedge-shaped section 70 is approximately equal to the beam of the vehicle 1. The taper surfaces 73, 74 may be linear surfaces, or may include convex curved surfaces (not shown) or concave curved surfaces (see FIG. 19) as view from the exterior of the vehicle 1.

In one embodiment shown in FIGS. 13–17, the wedge shape fairing 70 fairs into a substantially horizontal surface terminating in a movable horizontal control surface or elevator 62, allowing pitch or vertical depth control of the vehicle. Vertical control surfaces 61 can be mounted on the tapered surfaces of the wedge, providing yaw or turning control of the vehicle.

Stem Access Trunk or Passageway

As shown in FIGS. 13–17, an underwater vehicle 1 having wedge-shaped fairing 70 (e.g., a stern without a longitudinal centerline propulsion train having a shaft, bearings, and propeller) can incorporate a longitudinal centerline access trunk or passageway 80 extending longitudinally through the wedge-shaped fairing 70. The trunk 80 can be an extension of the forward pressure hull 9, and can include compartments and various fluid tight doors or hatches that can be accessed by personnel from the forward sections of the vehicle 1. In addition, electrical connections to propulsion pumps 27, hydraulic connections to control surfaces 60, and access to auxiliary equipment in the stern section 7 can be facilitated by the presence of the access trunk 80.

As shown in FIGS. 13–17, the trunk 80 extends from a first opening 81 at the aft pressure bulkhead of the primary pressure hull 9 aft through the wedge-shaped fairing 70 to a second opening 82 at the outer boundary layer proximate the aft distal end 72 of the stem 8 of the vehicle 1. A first watertight door or hatch 83 is provided at the first opening 81 to allow access between the inside of the primary pressure hull 9 and the trunk 80 and a second watertight door or hatch 84 is provided at the second opening 82 to allow access between the trunk 80 and the operating environment 2 or outside of the vehicle body 3. In one embodiment, a central circular water-tight trunk 80 can be located in the wedge shaped fairing 70. Preferably, the trunk 80 extends aft to the aft most location of the stern 8.

Figure 18:
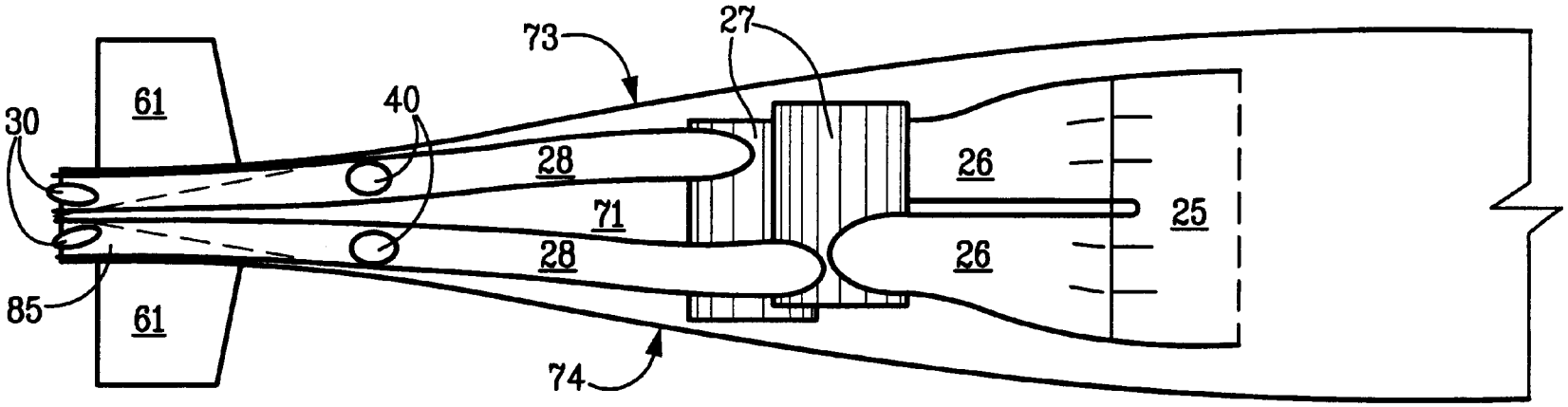
FIG. 18 is a cross-sectional side view of the stern section showing the location and lay-out of an exemplary thrust-driven propulsion system.

The trunk 80 can provide personnel access, entrance or egress from the stern 8 of the vehicle 1, or can be used to dispense/retrieve items to be towed behind the vehicle 1 or ejected/recovered from the vehicle 1 (see FIG. 18).

Control Surfaces

Control surfaces 60 may be included to provide for a smooth flow of the fluid over the outer hull 7 of the body 3 thereby improving the stability and the maneuverability of the vehicle 1.

As shown in FIGS. 15–18, the control surfaces 60 can include one or more of a vertical control surface 61 and a horizontal control surface 62. For example, the control surface can include one or more rudders 61 for controlling the horizontal movement (e.g., port and starboard turning in the yaw plane) of the vehicle 1, one or more horizontal plane control surfaces 62 for controlling the vertical movement (e.g., depth control in the pitch plane) of the vehicle 1, one or more planes (not shown) extending from the sides of the vehicle body 3 for stabilizing the vehicle and/or controlling the horizontal and/or vertical movement of the vehicle 1, and the like.

Optimum maneuvering performance of an underwater vehicle 1 at low and at high speeds can be further enhanced by the proper combination of conventional control surfaces 60 having vertical control surfaces (e.g., rudders) 61 and horizontal control surfaces (e.g., pitch planes) 62, and differential/vectored thrust capability. Differential horizontal control surfaces 62 can also improve control of vehicle roll or list angle. At low and mid-range speeds, a combination of one or more of differential thrust pumps, vectored thrust nozzles, backing nozzles, horizontal control surfaces, and rudders can work in combination to reduce the diameter of a turn and allows the vehicle to turn in its own length at low or zero speed. The availability of differential and vectored thrust provide additional control authority and redundancy at all speeds.

As shown in FIGS. 15–18, in embodiments of a vehicle 1 having a center trunk 80, port and starboard horizontal control surfaces 62 can be provided. In embodiments having multiple horizontal control surfaces 62, the port and starboard horizontal control surfaces 62 preferably operate independently to further assist in the horizontal turning to the vehicle 1, as well as pitch and roll control. As shown, the horizontal control surface 62 is disposed between the discharge nozzles 30 and includes a starboard horizontal control surface and a port horizontal control surface having a portion of the trunk 80 disposed therebetween. In embodiments not having a trunk 80, the horizontal control surface 62 can be a single surface.

In addition, the horizontal control surface(s) 62 can be positioned downstream (e.g. aft) of the fluid flow being discharged from the discharge nozzles 30. This arrangement can provide additional pitch control of the vehicle 1.

Control Systems

One or more control systems (not shown) are provided for controlling the operation and guidance of the vehicle. The control system(s) can control the operation of the fluid propulsor(s), the propulsion pump(s), the discharge nozzles thrust vectoring actuator system, the backing doors, the backing nozzles thrust vectoring actuator system, any control surface(s) actuator system, and any remote operated valves (not shown).

Exemplary Embodiments of the Wedge Shaped Stem Configuration

The following description of FIGS. 13–18 is provided to further assist in an understanding of the various embodiments of the wedge shaped stern configuration contemplated to be within the scope of the present invention. These examples are illustrative only and are not intended to limit the scope of the present invention.

Figure 13:
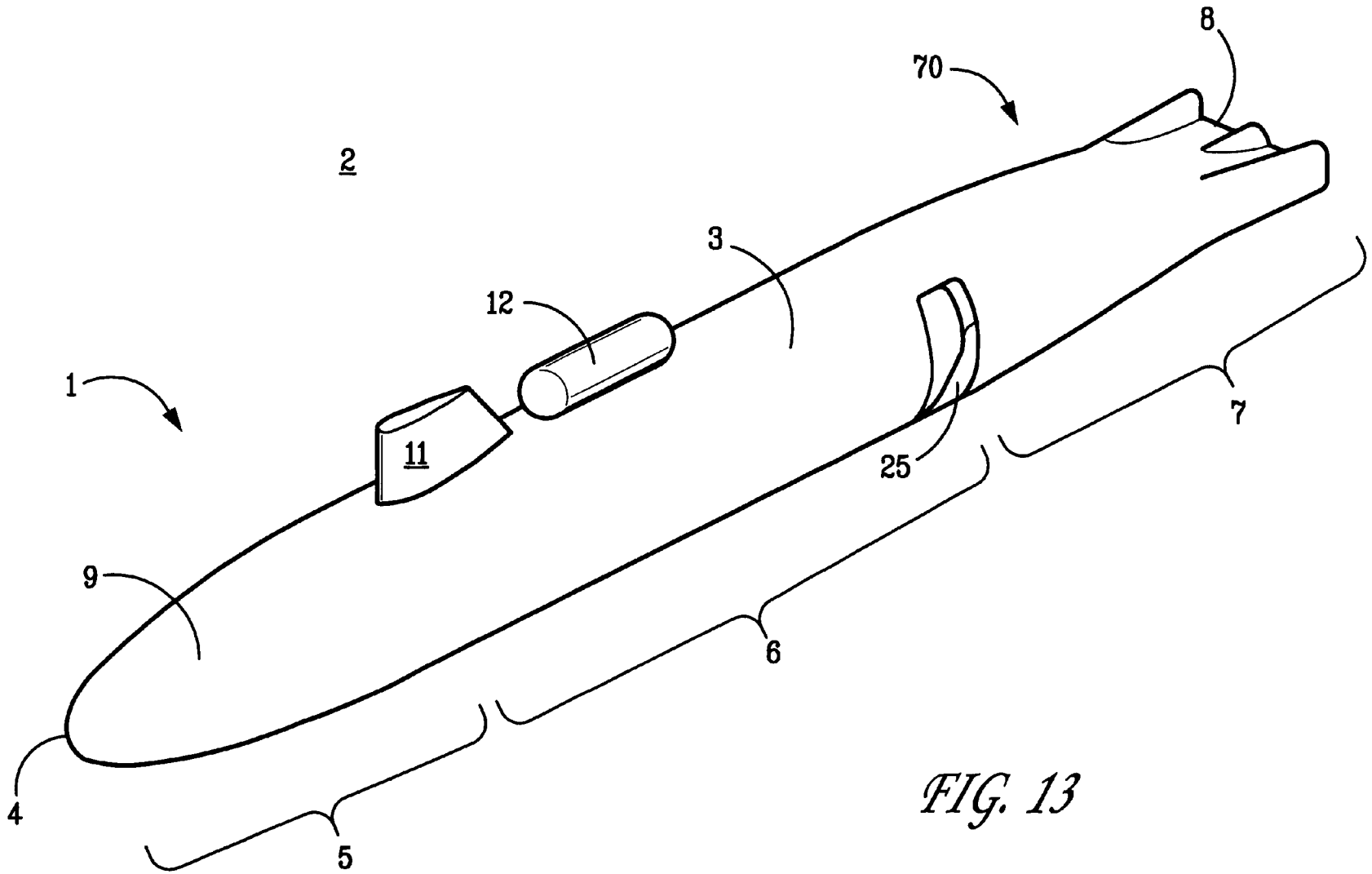
FIG. 13 shows an exemplary underwater vehicle having a wedge shaped stem configuration thereby providing an increased volume in the stern section and a trunk extending through the stern section.

FIG. 13 shows an exemplary underwater vehicle 1 having an elongated body 3, having an ellipsoidal bow section 5, a generally cylindrical mid-ship section 6, and a tapered wedge shaped fairing 70 at its stern section 7. FIG. 13 also shows a pair of laterally spaced apart discharge nozzles 30 and a pair of laterally spaced apart backing nozzles 40. In addition, a bow thrust propulsion system 50 is shown. FIGS. 14–18 show further details of various embodiments of the stern section 7 having a wedge shaped fairing 70.

Figure 14:
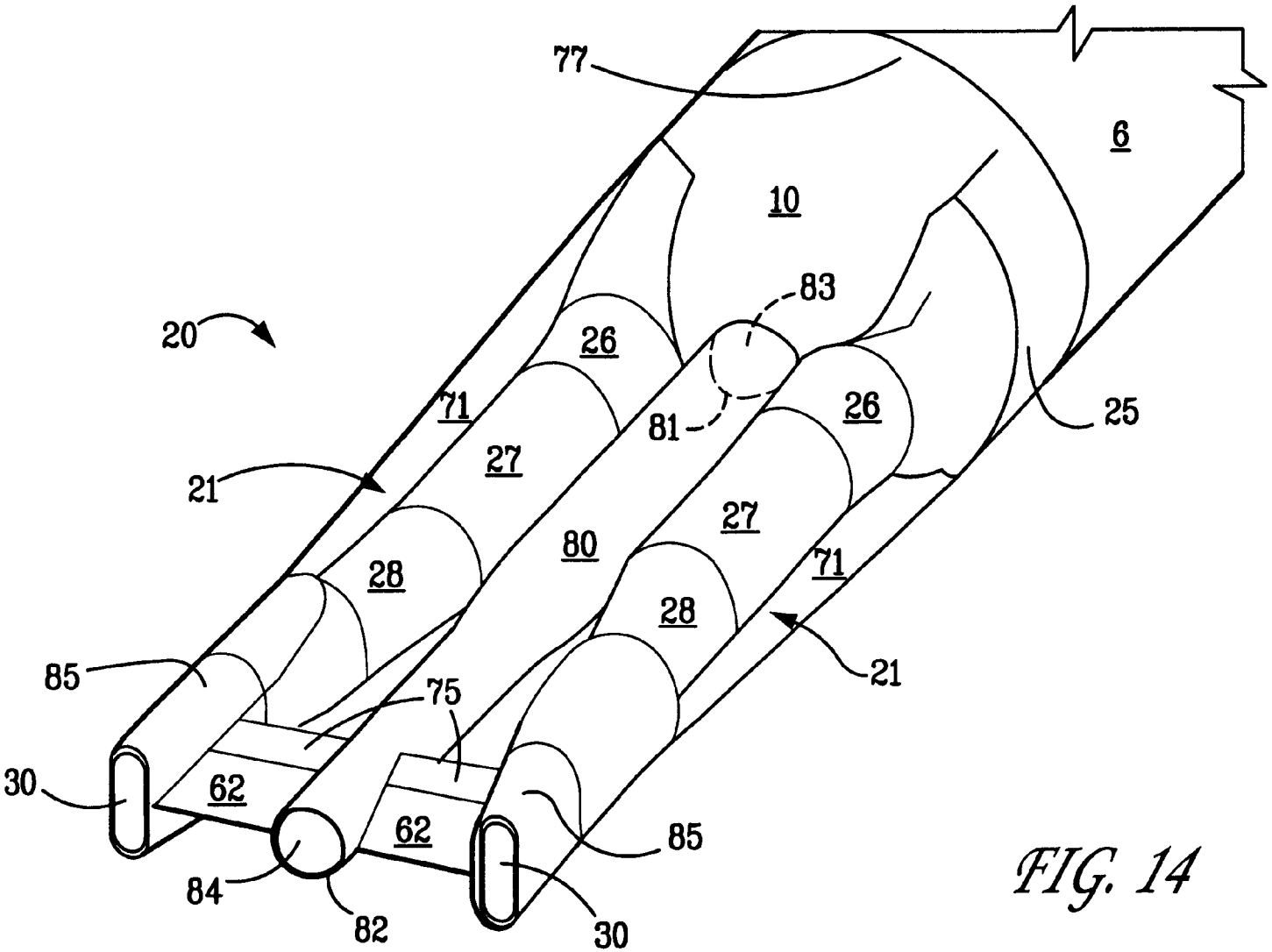
FIG. 14 shows a partial section view of the wedge shaped stern section showing the location and layout of an exemplary thrust-driven propulsion system.

FIG. 14 show a partial cut away of the wedge-shaped fairing 70 of FIG. 14. As shown in FIG. 14, the location and arrangement of a thrust-driven propulsion system 20 within the wedge-shaped stern section 70 can be seen. As shown, a starboard and a port partial annular inlet 25 allow fluid to enter the outer boundary surface of the vehicle 1. Inlet ducts 26 connect each inlet 25 with a pump 27 and the inlet ducts 26 contain and guide the fluid from the inlet openings 25 to the inlets of the pumps 27. The pumps 27 add hydraulic energy to the fluid and drive the fluid out through the outlet ducts 28 to the discharge nozzles 30. The fluid driven from the pumps 27 can be selectively diverted to backing nozzles 40.

As shown in FIGS. 13–18, the vehicle 1 further includes a trunk or passageway 80 extending through the internal volume defined by the wedge-shaped fairing 70. As shown, the trunk 80 includes a trunk door 84 is positioned over the opening 82 at the aft distal end of the trunk 80 to provide access between the inside of the trunk 80 and the operating environment 2. A first water tight door 83 is provided at the opening 81 where the trunk 80 connects to the primary pressure hull 9.

Figure 15:
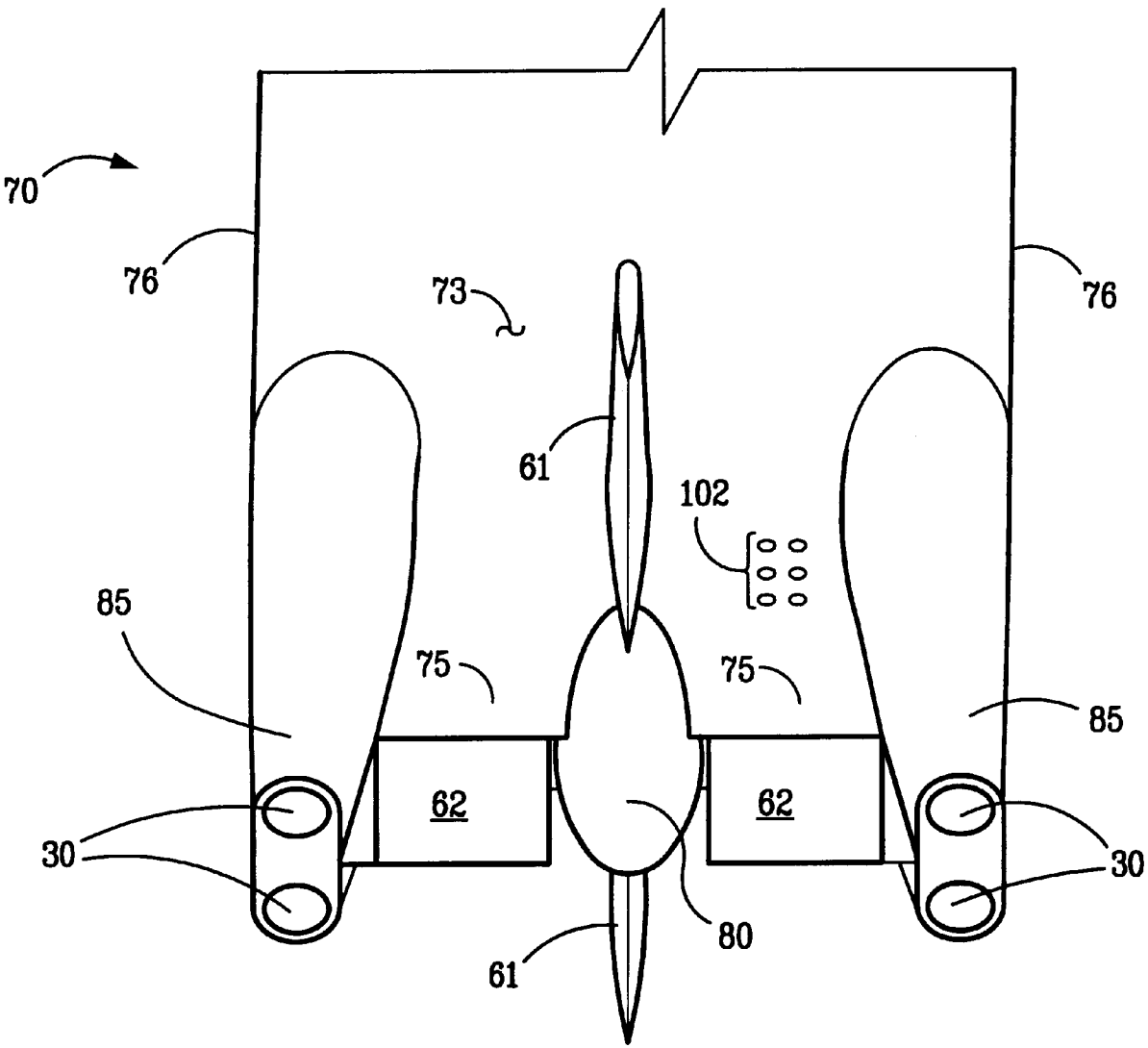
FIG. 15 shows a rear view of an exemplary wedge shaped stern section having vertical control surfaces and horizontal control surfaces.
Figure 16:
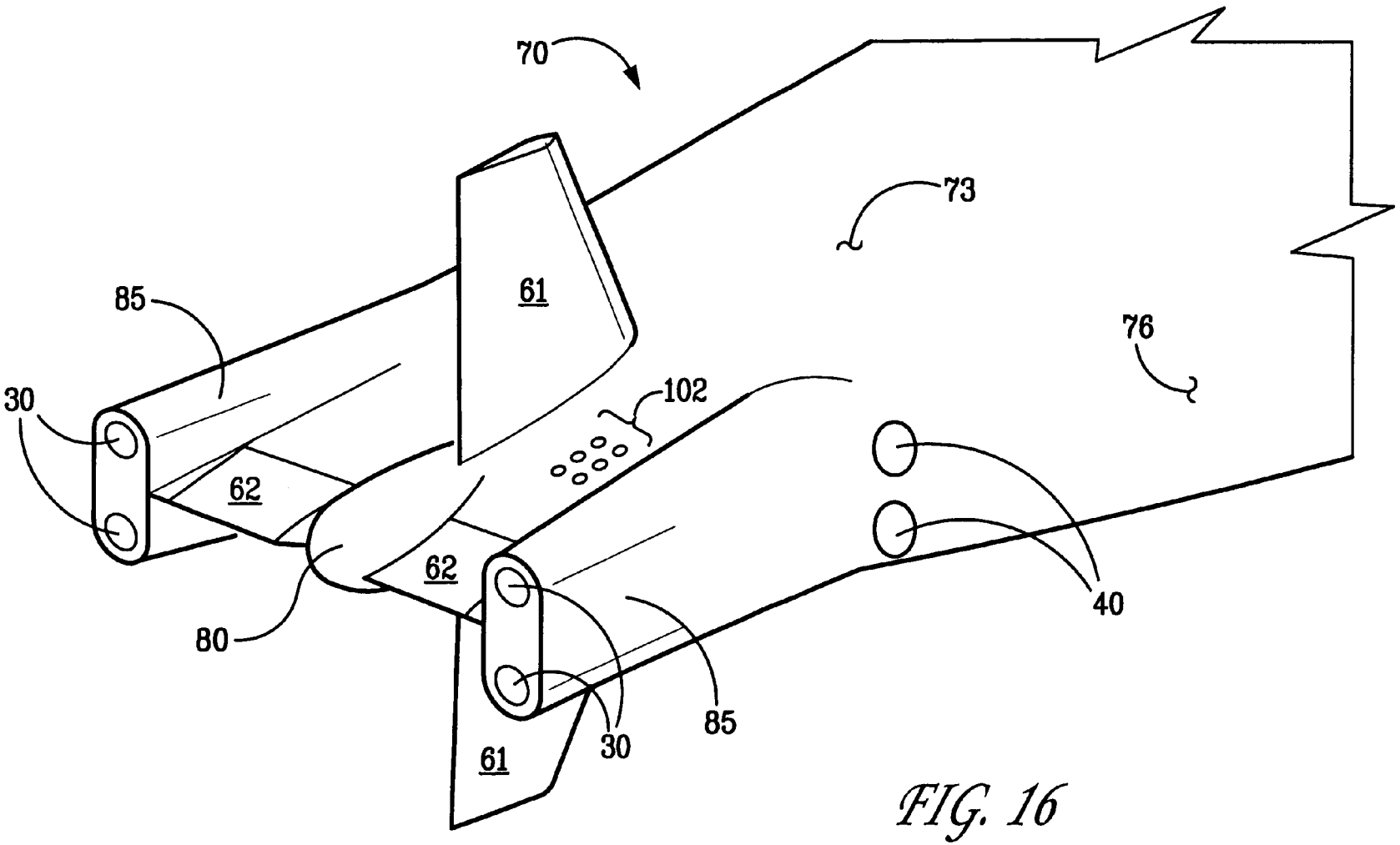
FIG. 16 shows a side perspective view of an exemplary embodiment of the wedge shaped stern section with horizontal and vertical control surfaces.
Figure 17:
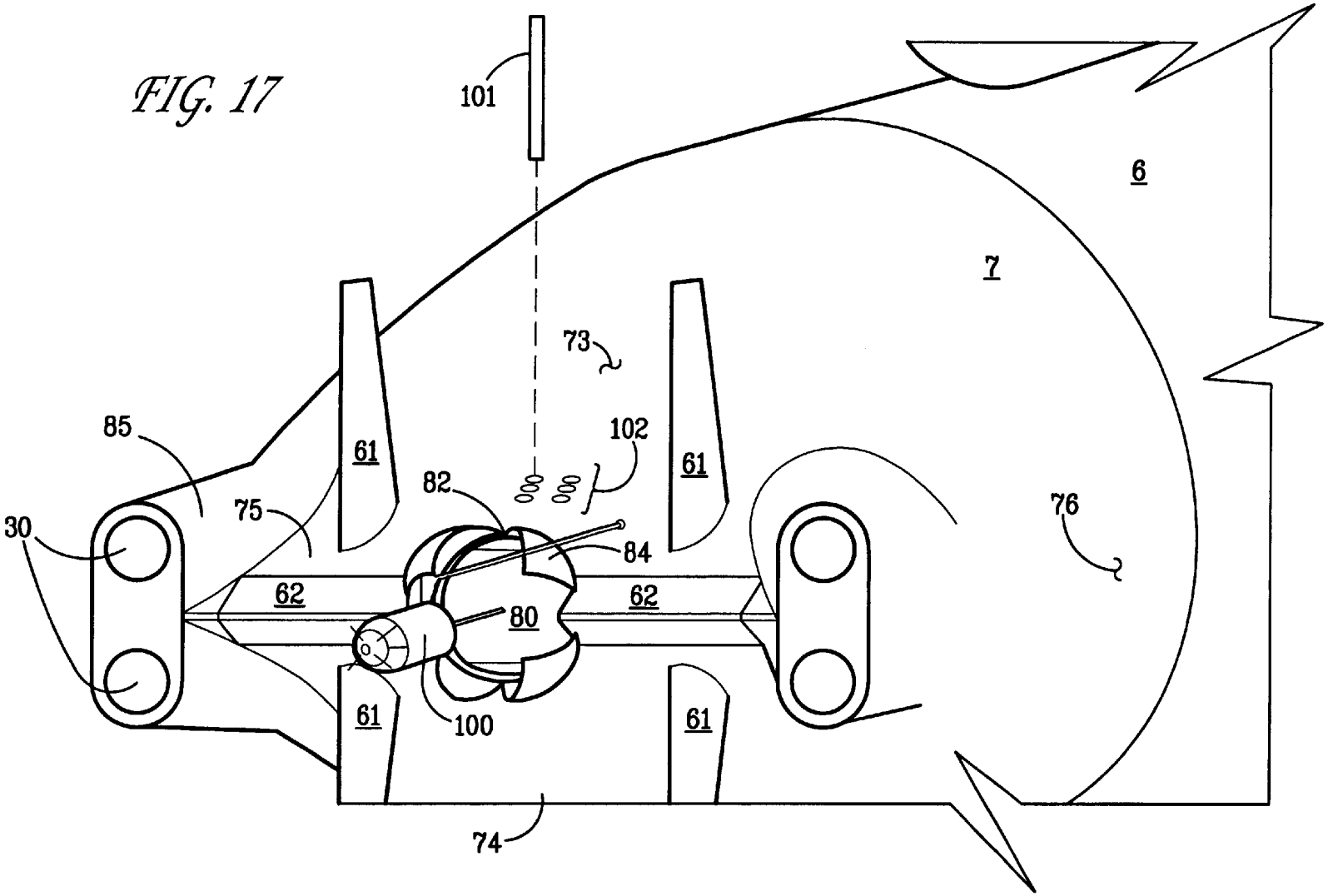
FIG. 17 shows an embodiment of an underwater vehicle wherein the stem section includes a wedge shaped stern section having a twin upper and lower rudder configuration as an example of an alternative control surface arrangement.

FIGS. 15–18 show embodiments of the underwater vehicle 1 having one or more control surfaces 60, including one or more rudders 61 and one or more horizontal control surfaces 62. For example, as shown in FIGS. 16 and 17, the vehicle 1 can include a single rudder 61 located along the centerline of the vehicle 1. Alternatively, as shown in FIG. 18, the vehicle 1 can include two rudders 61 that are located laterally spaced-apart at the stern section 7. FIG. 18 shows a twin upper and lower rudder configuration as an example of an alternative control surface arrangement. The rudder(s) 61 can be positioned such that they extend from the upper surface 73 and/or the lower surface 74 of the tapered wedge shaped fairing 70. The rudders may be operated singly or collectively.

Figure 19:
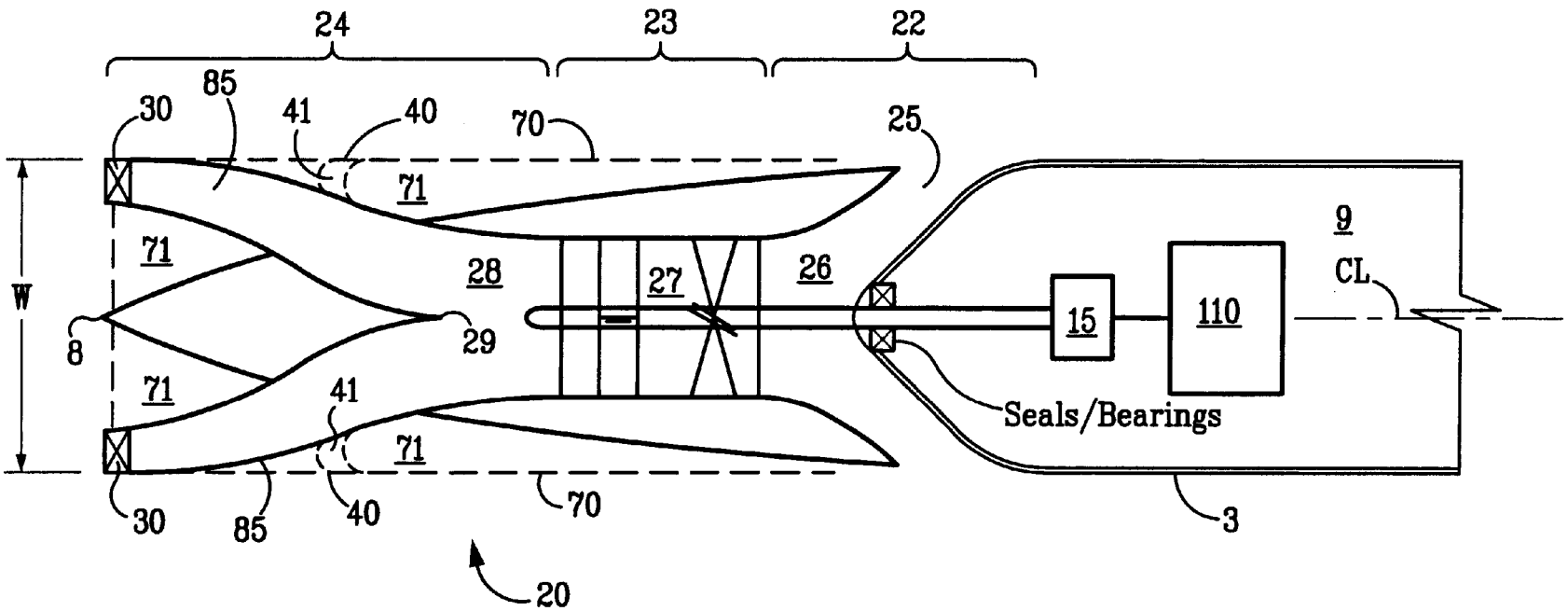
FIG. 19 is a plan view showing alternative stern configurations.

FIGS. 14, 18, and 19 show how the additional volume defined by the wedge-shaped fairing 70 can be used to store and deploy sensors, countermeasures, weapons, linear arrays, towed arrays, rescue vehicles, swimmers, and the like. The additional volume of the wedge-shaped fairing 70 can be used for these and other services due, in part, to the fact that the thrust-driven propulsion system 20 does not include any rotating shafting or any rotating external propeller(s), as is conventional in many underwater vehicles.

FIGS. 15 and 16 shows the underwater vehicle 1 with the trunk door in the closed position. The trunk door forms a watertight seal between the trunk 80 and the operating environment 2. FIG. 18 shows the trunk door in the open position. FIG. 18 also shows an exemplary device 100 being deployed/retrieved from the trunk 80 through the open trunk door 84. The deployed device 100 can be tethered or untethered to the vehicle 1.

FIG. 17 also shows countermeasures 101 being launched from holding cell(s) 102 opening in the upper surface 73 of the wedge-shaped fairing 70.

Referring back to FIGS. 1 and 13, the body 3 of the underwater vehicle is preferably constructed to minimize drag and turbulence of the fluid flowing over the body 3 at the outer boundary of the vehicle 1. In addition, to the extent that control structures or equipment extend from or are mounted to the outer hull surface of the vehicle, these structures and equipment are preferably located so that any resulting turbulence in the wake of the object is not ingested into the thrust vectored propulsion system 20.

For example, as shown in FIGS. 1 and 13, a mast structure 104 may extend from the top of the vehicle body 3. The mast is located on the top side of the body so that any turbulence in the mast's wake resulting from the mast will not be introduced into the partial annular inlets located on the sides of the body. Likewise, FIG. 1 also shows a Deep Sea Rescue Vehicle (DSRV) or stores container 105 located in a similar position on the top side of the body behind the mast 104. This location is also chosen for similar reason relating to reducing/preventing the introduction of a turbulent wake into the inlets, thereby reducing the likelihood of cavitation in the pumps 27.

Alternative Stem Configurations

FIG. 19 shows a vehicle 1 having a thrust-driven propulsion system 20 and two alternative stern configurations. In a first exemplary embodiment shown in solid lines in FIG. 19, the vehicle 1 has a stern configuration including a tapered aft conical stern section having at least two faired discharge ducts 85 that extend outward and rearward from the stern section 7 and include portions of the outlet ducts 28 and the discharge nozzles 30. The faired discharge ducts 85 allow the discharge nozzles 30 to be positioned in a laterally spaced apart relationship on opposite side of the longitudinal axis CL of the vehicle 1 (see also, FIG. 37).

In a second exemplary embodiment shown in dashed lines in FIG. 19, the vehicle 1 has a stern configuration including a wedge shaped fairing 70 that provides a space 71 and covering in which the at least two discharge nozzles 30 can be positioned. The wedge shaped fairing 70 also provides a maximum lateral (e.g., along the X-axis or horizontal beam) distance L apart, resulting in the improved control and maneuvering of the vehicle 1 using the thrust-driven propulsion system 20.

Note that the wedge shaped stern configuration 70 is not critical to the operation of the thrust-driven propulsion system 20. Likewise, the thrust-driven propulsion system 20 is not critical to the operation of the wedge shaped stern configuration 70.

Accordingly, the embodiments shown in FIGS. 3–7 can include alternative stern configurations, such as those shown in FIGS. 13–18. Similarly, the wedge shaped stern configuration 70 shown in FIGS. 13–18 can include alternative propulsion systems, including conventional shaft driven propeller, pumpjet propulsors, and the like (not shown).

Distributed Propulsion System

The underwater vehicle 1 preferably includes a distributed power and propulsion system 110 including multiple sources of power for providing power to the thrust-driven propulsion system 20. FIG. 20 shows an arrangement of the power generation, distribution, and control network that can be used with the thrust vectoring propulsion system 20. As shown in FIG. 20, the distributed, modular components result in the flexible arrangement and interconnectibility of the power generation, distribution, and control equipment includes power source(s) 111, turbo generator(s) 112, controller(s) 113, and propulsion pump(s) 27.

The power source 111 can include any suitable energy source for generating power, such as, for example, electrical, mechanical, chemical, nuclear, and the like. The turbo generators 112 convert the energy output from the energy source into electrical energy. The electronic controls and bus system 113 control the distribution of the electrical power. The electronic controls can also control the operation of the pumps, hydraulic actuator systems, and the like. For redundancy and survivability purposes, an electrical cross-connection can be provided between one or more of the electronic controllers and one or more of the pumps. In one preferred embodiment, the vehicle 1 includes an all electric distributed power system with multiple generators.

Flexible System Arrangement

FIGS. 21A and 21B show a comparison of the distributed propulsion system 50 of FIG. 20 (see FIG. 21A) compared to a conventional single shaft propulsion train (see FIG. 21B). As can be seen in FIGS. 21A and 21B, the distributed propulsion system 50 utilizes fewer components than a conventional shaft propulsion system. In addition, the wedge-shape fairing 70 defines space 71 that provides an increased volume aft for the location of machinery/equipment and allows for a trunk(s) or passageway(s) through the stern section 7.

The single shaft propulsion train shown in FIG. 21B requires a very precise layout of equipment and machinery to ensure the proper shaft alignment. This is a very time consuming and expensive process. Also, there is not much flexibility in where each piece of equipment and machinery can be located and arranged due to the requirement of a rotating shaft located along the longitudinal centerline of the vehicle or two rotating shafts on either side of the longitudinal centerline.

On the other hand, the thrust vectored propulsion system shown in FIG. 21A provides a great deal of flexibility in the arrangement options of the equipment and machinery. As shown, the propulsion system can be located anywhere in the primary pressure hull 9. The output from the propulsion units can be coupled to an electric drive that is also located in the primary pressure hull 9. The output from the electric drive can be coupled to the propulsion pumps that can be located outside the primary pressure hull 9 in the wedge-shaped stem section 70. The electric controls for the pumps and the hydraulic controls for the thrust vectorable discharge nozzles and control surfaces can be located in the trunk that extends through the wedge-shaped stern section 70. This provides easy access to the controls for maintenance and repair.

Advantages and New Features of Preferred Embodiments

The vectored thrust propulsion system and wedge-shaped stern configuration provide several performance enhancements in the areas of maneuvering, sea-keeping, vibration control, cavitation, and the like.

Underwater vehicles require positive depth control, small yaw turning radius and the ability to maneuver precisely at low speed. Conventional control surfaces produce force by aerodynamic lift and are consequently less effective at low speed. The ability to utilize vectored thrust for turning and backing overcomes this difficulty and allows the conventional control surfaces to be optimized for high-speed turns and depth control.

Elimination of the turbine/gearbox/shaft/bearing/seal/propeller assembly offers a significant saving in construction time and machinery alignment cost. The use of a number of modular, smaller size pumps facilitates construction and maintenance of the vehicle propulsion system. The smaller size of the pumps and motors and controllers are more compatible with existing manufacturing capability and will increase the number of potential suppliers vice the few sources of manufacture and repair for current propulsors and mechanical drive systems. Smaller pumps should generally cost less and require less tolerance than larger, single units.

Redundancy of critical components (pumps and motors) allows operations and repairs to be conducted with portions of the system removed from service. The internal generation of power can also be built in a modular manner with a separate power generation and control channel/train for each pump with the same benefits of industrial base supply and support of repairs.

The thrust-driven propulsion system generates reverse thrust by directing the flow in the linear nozzle in the normally astern direction to the ahead direction. When the diverter device is actuated to produce reverse thrust it also closes off the flow in the astern direction.

The stern configuration shown in the figures are preferred embodiments of the invention only. The actual size and specific configuration would be obtained following a detailed design for a particular vehicle application in terms of the vehicle size and performance requirements. The control surfaces shown in the diagrams are notional and there are several variants possible. The rudders are shown on the centerline (see, for example, FIG. 15) and off the centerline (see, for example, FIG. 17) depending on whether the rudder linkage and actuation would penetrate the trunk (providing there is only one trunk and it is located on the centerline) or whether the whole truck would be used to launch vehicles or sensors. There could be single or twin rudders above and below the stern.

While the invention has been particularly shown and described with reference to preferred embodiments thereof, it will be understood by those skilled in the art that various alterations in form and detail may be made therein without departing from the spirit and scope of the invention. In particular, the specific shape of the forward, mid and aft sections of the vehicle can be altered without departing from the scope of the invention. Additionally, the number and exact location of the inlet duct, pumps, exit nozzles, controlling surfaces, etc. can be varied by a person of ordinary skill in the art to meet common design specifications.

What is claimed is:

1. An underwater vehicle comprising:

an elongated body having a bow, a forward section, a mid-section, an aft section, and a stern;

at least one inlet opening in said body for receiving a fluid from an external fluid operating environment into said body;

inlet ducting having a first end and a second end, said first end connected to said at least one inlet opening, said inlet ducting containing and guiding said fluid as it flows internal to said body;

at least one propulsion pump connected to said second end of said inlet ducting, said at least one propulsion pump adding hydraulic energy to said fluid to induce a flow of said fluid though said body;

outlet ducting having a first end and a second end, said first end connected to said at least one propulsion pump, said outlet ducting containing and guiding said fluid as it flows internal to said body;

at least two discharge nozzles connected to said second end of said outlet ducting at said aft section, said at least two discharge nozzles positioned in a laterally spaced apart relationship along a horizontal beam of said body on opposite sides of a longitudinal centerline axis;

wherein said at least two discharge nozzles providing propulsive thrust to propel said vehicle through said fluid operating environment; and wherein said at least two discharge nozzles are capable of producing one or more of a differential thrust and a vectored thrust to maneuver said vehicle through said fluid operating environment.

2. The underwater vehicle of claim 1, further comprising at least two propulsion pumps each having a variable speed power source for driving each of said at least two propulsion pumps at differential speeds thereby allowing said at least two propulsion pumps to drive a differential flow of fluid to said at least two laterally spaced apart discharge nozzles that produce differential thrust to propel and maneuver said vehicle through said fluid operating environment.

3. The underwater vehicle of claim 1, wherein said discharge nozzles discharge a fluid flow in a normally rearward direction and wherein said discharge nozzles are movable to produce vectored thrust in multiple degrees of freedom.

4. The underwater vehicle of claim 3, wherein said discharge nozzles are vectorable in at least two directions comprising a horizontal direction and a vertical direction to produce a vectored thrust in a yaw plane for turning to port and starboard and a pitch plane for diving and ascending.

5. The underwater vehicle of claim 4, wherein said discharge nozzles are independently vectorable in said at least two directions to further control yaw, pitch, and roll of said vehicle.

6. The underwater vehicle of claim 1, further comprising a vectored thrust actuator system comprising at least one yaw actuator coupled to one side of each of said discharge nozzles for moving said discharge nozzle in a horizontal plane and at least one pitch actuator couple to one of a top and bottom of each of said discharge nozzles for moving said discharge nozzle in a vertical plane.

7. The underwater vehicle of claim 1, wherein said discharge nozzles are mounted on gimbals allowing movement of said discharge nozzles in three degrees of freedom to produce vectored thrust in multiple degrees of freedom for propelling and maneuvering said vehicle.

8. The underwater vehicle of claim 1, further comprising at least two backing nozzles selectively fluidly connected to an outlet of said at least one propulsion pumps for producing a backing thrust to slow a forward motion of said vehicle and to propel said vehicle generally in a backward axial direction.

9. The underwater vehicle of claim 8, wherein said backing nozzles discharge a flow of fluid in a normal direction that is generally forward toward said forward section and wherein said backing nozzles are vectorable in at least two directions comprising a fore and athwartship direction and a vertical direction to produce a vectored thrust to further assist with propelling and maneuvering said vehicle.

10. The underwater vehicle of claim 8, wherein said backing nozzles are independently vectorable in said at least two directions to control yaw, pitch, and roll of said vehicle.

11. The underwater vehicle of claim 8, further comprising a backing door for selectively diverting a flow of said fluid exiting said propulsion pump to one of said discharge nozzles and said backing nozzles.

12. The underwater vehicle of claim 11, further comprising backing ducting and a backing door actuator system, wherein said backing door actuator system moves said backing door between:

a first position wherein said flow diverter device closes off said backing ducting and said flow of fluid exiting said propulsion pump flows to said discharge nozzles; and a second position wherein said flow diverter device opens said backing ducting and said flow of fluid exiting said fluid propulsor flows to said backing nozzles.

13. The underwater vehicle of claim 1, wherein each of said at least one propulsion pump comprises a double suction mixed flow pump having a motor directly coupled and adjacent to said pump.

14. The underwater vehicle of claim 1, wherein said at least one inlet opening comprises two partial annular inlet openings positioned symmetrically with one partial annular inlet opening on a port side and one partial annular inlet opening a starboard side of a forward end of said aft section.

15. The underwater vehicle of claim 1, wherein said at least one inlet opening comprises a partial annular inlet opening that extends over approximately three quarters of a circumference of said body from said port side across a bottom to said starboard side.

16. The underwater vehicle of claim 1, wherein said inlet openings are positioned in said body to minimize or exclude one or more of surface and bottom debris, air, and turbulence resulting from external protrusions from said body from entering said inlet openings.

17. The underwater vehicle of claim 1, further comprising a pair of faired discharge ducts extending outward and rearward from said aft section of said body, wherein at least a portion of outlet ducting extends through each faired discharge duct and wherein one of said at least two discharge nozzles is located at a distal end of each faired discharge duct.

18. The underwater vehicle of claim 1, further comprising one or more of a vertical control surface extending in a vertical plane from said aft section and a horizontal control surface extending in a horizontal plane from said aft section, wherein said vertical control surface further facilitate maneuvering of said vehicle on a yaw plane and said horizontal control surface further facilitate maneuvering of said vehicle on a pitch plane.

19. The underwater vehicle of claim 1, further comprising a secondary thrust-driven propulsion system in said forward section, said secondary thrust-driven propulsion system comprising:

at least one secondary inlet opening in said body;

secondary inlet ducting connected to said secondary inlet opening for guiding a flow of fluid therethrough;

at least one secondary propulsion pump connected to said secondary inlet ducting for adding hydraulic energy to a fluid to drive said fluid through said secondary thrust-driven propulsion system; secondary outlet ducting connected to said secondary propulsion pump for guiding a flow of fluid therethrough;

at least two secondary discharge nozzles connected to said bow outlet ducting for discharging said fluid being driven by said at least one secondary propulsion pump to produce a secondary thrust, said at least two secondary discharge nozzles being disposed in a laterally spaced apart relationship with one secondary discharge nozzle being position on a port side of said vehicle body and one secondary discharge nozzle being positioned on a starboard side of said vehicle body; and wherein said at least two secondary discharge nozzles are capable of producing one or more of a differential thrust and a vectored thrust.

20. The underwater vehicle of claim 19, wherein said differential thrust is generated by one or more of:

variable speed secondary propulsion pumps to selectively adjust an output from two or more secondary propulsion pumps; and a diverter plate in said outlet ducting of each of said at least two secondary discharge nozzles to selectively divert a portion of said fluid away from said secondary discharge nozzle;

wherein a resulting flow to each of said secondary discharge nozzles is of a different magnitude and differential thrust results.

21. The underwater vehicle of claim 19, wherein said vectored thrust is generated by changing a position of each of said at least two secondary discharge nozzles using a secondary vectored thrust actuator system such that a direction of flow discharging from each of said secondary discharge nozzles is of a different direction and vectored thrust results.

22. The underwater vehicle of claim 1, further comprising a distributed power generation, distribution, and control system comprising:

at least one power source located in a primary pressure hull of said body;

a plurality of turbo-generators located in a primary pressure hull of said body for converting a power output from said power source to electrical energy;

controllers and a bus system located in a primary pressure hull of said body for controlling the distribution of electrical energy;

at least one propulsion driver located in one of said primary pressure hull and a fairing extending aft from said primary pressure hull at said aft section of said body;

at least one propulsion pump located in said fairing, said at least one propulsion pump being coupled to said at least one propulsion driver.

23. The underwater vehicle of claim 1, further comprising a wedge shaped fairing connected at a forward end to said mid-ship section and tapering aft toward said stem, said wedge shaped fairing having a substantially constant width as it tapers aft, said wedge shaped stem section defining a space at said aft section that provides an increase volume for wet or dry storage.

24. The underwater vehicle of claim 23, wherein said wedge-shaped fairing further comprises:

an upper tapered surface having a constant width substantially equal to a beam of said body and that tapers downward aft toward said stem;

a lower tapered surface having a constant width substantially equal to a beam of said body and that tapers upward aft toward said stem;

port and starboard sidewalls that are disposed between and connect said upper tapered surface to said lower tapered surface; and a horizontal edge formed along a horizontal beam where said upper tapered surface to said lower tapered surface meet at an aft distal end at said stern of said vehicle.

25. The underwater vehicle of claim 23, further comprising a horizontal control surface, wherein said wedge-shaped fairing fairs into a substantially flat control surface in the horizontal plane that is movable to allow pitch or vertical depth control of said vehicle.

26. The underwater vehicle of claim 23, further comprising a trunk extending through said space defined by said wedge-shaped fairing, and wherein said trunk may be selectively connected to and pressurized from a primary pressure hull of said vehicle.

27. The underwater vehicle of claim 26, further comprising a trunk door that selectively opens and closes a trunk opening between said trunk and said fluid operating environment for one or more of dispensing and retrieving devices from said stern of said vehicle.

28. The underwater vehicle of claim 26, wherein said at least one propulsion pump is located in said space defined by said wedge-shaped stern section and one or more of a propulsion pump control system, nozzle vectoring actuator system, control surface actuator system, and a hydraulic actuator control system are located in said trunk.

29. An underwater vehicle having an elongated body comprising:

a bow at a forward distal end of said body;

a stern at an after distal end of said body;

an ellipsoidal bow section at said forward end of said body;

a cylindrical central section connected to said bow section; and a stern section connected to said central section, said stern section comprising a wedge shaped fairing, said wedge shaped fairing having a substantially constant width and tapering smoothly from a first cylindrical end connected to said central section to a second end forming a horizontal edge at said aft distal end of said body;

said wedge shaped stern section defining a space having an increased volume at said stern for housing additional ship systems and stores.

30. The underwater vehicle of claim 29, wherein said wedge shaped stern section further comprises:

an upper tapered surface that tapers downward from said first end to said second end;

a lower tapered surface that tapers upward from said first end to said second end;

port and starboard sidewalls that are disposed between and connect said upper tapered surface to said lower tapered surface; and wherein said horizontal edge is formed along a horizontal beam where said upper tapered surface to said lower tapered surface meet at said aft distal end of said body.

31. The underwater vehicle of claim 29, wherein said wedge shaped fairing further comprises:

a trunk extending through said space defined by said wedge-shaped fairing, and wherein said trunk may be pressurized from a primary pressure hull of said vehicle;

a trunk opening between said trunk and a fluid operating environment in which said vehicle operates; and a trunk door that selectively opens and closes said trunk opening for one or more of dispensing and retrieving devices from said stern of said vehicle.

32. The underwater vehicle of claim 29, further comprising a thrust-driven propulsion system having at least one propulsion pump, outlet ducting, and at least two discharge nozzles located in said space defined by said wedge shaped fairing, and one or more of a control system and an actuator system located in said trunk.

33. The underwater vehicle of claim 29 wherein said space defined by said wedge shaped fairing is further defined by a watertight pressure bulkhead at an aft end of said central section.

34. The underwater vehicle of claim 29, wherein said upper tapered surface and said lower tapered surface comprise contoured surfaces having a curved concave shape toward a longitudinal centerline axis.

35. The underwater vehicle of claim 29, further comprising a port faired discharge duct extending longitudinally along a port side of said wedge shaped fairing and a starboard faired discharge duct extending longitudinally along a starboard side of said wedge shaped fairing, wherein at least one discharge nozzle for discharging a fluid to produce thrust is located in each of said port faired discharge duct and said starboard faired discharge duct.

36. A distributed propulsion system for propelling and maneuvering a submersible vehicle having an elongated body having a primary pressure hull through a fluid medium comprising:

a wedge-shaped fairing connected to an aft end of said primary pressure hull and extending longitudinally aft therefrom;

said wedge shaped fairing defining a space having an increased volume;

one or more inlets in said space for ingesting fluid from said fluid medium into said elongated body;

one or more inlet ducts positioned internally to said space, each inlet duct having a first end and a second end, wherein said first end is connected to at least one of said one or more inlets;

one or more propulsion pumps for adding hydraulic energy to said ingested fluid mounted internally to said space and connected to said second end of at least one of said one or more inlet ducts;

at least two discharge ducts positioned internally to said space, each outlet duct having a first end and a second end, wherein said first end is connected to at least one of said one or more propulsion pumps;

at least two discharge nozzles connected to said second end of said one or more outlet ducts at an aft distal end of said space defined by said wedge shaped fairing, said discharge nozzles discharging said fluid medium from said elongated body for discharging said fluid from said vehicle body to said fluid medium;

wherein said at least two discharge nozzles are positioned in a laterally spaced apart relationship in said wedge-shaped stern section to provide one of a differential and a vectored thrust for propelling and maneuvering said vehicle.

37. A method for propelling and maneuvering an underwater vehicle through a fluid operating environment comprising the steps of:

providing a body having an ellipsoidal shaped bow section, a cylindrical mid-ship section, and a stern section;

ingesting fluid from said operating environment into said body through one or more inlet openings;

guiding said fluid through said body through internal ducts;

driving said fluid through said ducts using one or more pumps to add hydraulic energy to said fluid passing through said ducts;

propelling said body through said fluid operating environment by discharging said fluid exiting from said pumps through at least two discharge nozzles positioned at said stern section in a laterally spaced apart relationship along a horizontal beam on opposite side of a longitudinal centerline of said body; and maneuvering said body through said fluid operating environment by controlling one of a magnitude and a direction of said fluid being discharged from said body thereby producing one or more of a differential and a vectored thrust.

38. The method of claim 37, further comprising the step of varying the speed of a power source used to drive said pumps to produce differential thrust for controlling one or more of yaw, pitch, and roll of said vehicle.

39. The method of claim 37, further comprising the step of moving said discharge nozzles in at least two dimensions to produce vectored thrust in multiple degrees of freedom for controlling one or more of yaw, pitch, and roll of said vehicle.

40. The method of claim 37, further comprising the steps of:

diverting said fluid exiting said one or more pumps to at least two backing nozzles positioned at said stern section in a laterally spaced apart relationship with at least one backing nozzle being positioned along a port side and at least one backing nozzle being positioned along a starboard side of said body to provide a backing thrust;

reversing and/or stopping said body by discharging said fluid exiting from said pumps through at least two backing nozzles; and maneuvering said body through said fluid operating environment by controlling one of a magnitude and a direction of said fluid being discharged from said body thereby producing one or more of a differential and a vectored thrust.

41. The method of claim 37, further comprising the step of providing a secondary thrust-driven propulsion system in said bow section of said body;

ingesting fluid through at least one secondary inlet opening in said body;

driving said ingested fluid using one or more secondary pumps connected to said secondary inlet ducting;

discharging said driven fluid through at least two secondary discharge nozzles connected to said secondary pumps to produce a secondary thrust, said at least two secondary discharge nozzles being disposed in a laterally spaced apart relationship with one secondary discharge nozzle being position on a port side of said vehicle body and one secondary discharge nozzle being positioned on a starboard side of said vehicle body; and producing one or more of a differential thrust and a vectored thrust by controlling a magnitude and a direction of said fluid flow being discharged through said secondary discharge nozzles.

* * * * *